US008750745B2

(12) United States Patent
Fujiwara

(10) Patent No.: US 8,750,745 B2
(45) Date of Patent: Jun. 10, 2014

(54) IMAGE FORMING APPARATUS WITH HIGH-VOLTAGE BOARD

(75) Inventor: Daisuke Fujiwara, Osaka (JP)

(73) Assignee: Kyocera Mita Corporation (JP)

( * ) Notice: Subject to any disclaimer, the term of this patent is extended or adjusted under 35 U.S.C. 154(b) by 508 days.

(21) Appl. No.: 13/153,767

(22) Filed: Jun. 6, 2011

(65) Prior Publication Data

US 2011/0299874 A1 Dec. 8, 2011

(30) Foreign Application Priority Data

Jun. 7, 2010 (JP) ..... 2010-129914

(51) Int. Cl.
*G03G 15/00* (2006.01)

(52) U.S. Cl.
USPC ..... 399/90; 399/88

(58) Field of Classification Search
USPC ..... 399/88, 90
See application file for complete search history.

(56) References Cited

U.S. PATENT DOCUMENTS

| | | | | |
|---|---|---|---|---|
| 2003/0109153 | A1 | 6/2003 | Tomimori | |
| 2006/0291893 | A1 | 12/2006 | Yano | |
| 2011/0262173 | A1* | 10/2011 | Souda | 399/89 |

FOREIGN PATENT DOCUMENTS

| | | |
|---|---|---|
| JP | 2008-242070 | 10/2008 |
| JP | 2009-109781 | 5/2009 |
| JP | 2009-115931 | 5/2009 |
| JP | 2010-8670 | 1/2010 |

OTHER PUBLICATIONS

Ono (JP 2010-008670 A), Jan. 2010, JPO Computer Translation.*

* cited by examiner

*Primary Examiner* — David Gray
*Assistant Examiner* — Erika J Villalina
(74) *Attorney, Agent, or Firm* — Gerald E. Hespos; Michael J. Porco; Matthew T. Hespos

(57) ABSTRACT

An image forming apparatus has a first unit for performing an image forming process on a sheet, a frame having a first surface facing the first unit and a second surface opposite the first surface. A second unit is mounted on the second surface of the frame and a high-voltage board is mounted on the second surface of the frame with the second unit located therebetween. A connecting mechanism electrically connects the first unit and the high-voltage board to supply high voltage to the first unit. The connecting mechanism includes a unit-side wire extending at a side of the first surface and a board-side wire connectable to the unit-side wire and extending at a side of the second surface. The unit-side wire and the board-side wire are connected with contacts thereof pressed into contact with each other.

4 Claims, 24 Drawing Sheets

IMAGE FORMING APPARATUS WITH HIGH-VOLTAGE BOARD

BACKGROUND OF THE INVENTION

1. Field of the Invention

The present invention relates to an electrophotographic image forming apparatus and particularly to a connecting structure for electrically connecting units for performing an image forming process on a sheet and a high-voltage board for supplying high voltages to the units.

2. Description of the Related Art

An electrophotographic image forming apparatus such as a printer or a facsimile machine includes a plurality of built-in processing units for performing an image forming process on a sheet. The processing units include, for example, a photoconductive drum unit on which a toner image is to be formed, a developing unit for forming a toner image on the photoconductive drum by supplying toner to the photoconductive drum and an intermediate transfer unit including an intermediate transfer belt to which a color toner image is to be transferred when the image forming apparatus is of a tandem type.

The image forming apparatus further includes a high-voltage board for supplying high voltages to the above processing units. The high-voltage board and the processing units are electrically connected by connecting members. In a conventional image forming apparatus, coiled contacts of connecting members of processing units are pressed into contact with planar contacts of connecting members of a high-voltage board to electrically connect the processing units and the high-voltage board when the processing units are mounted into a housing.

Image forming apparatuses of recent years are required to be small in size. This not only reduces spaces around processing units, but also leads to such a structure that other constituent parts are incorporated between the processing units and the high-voltage board. Thus, connecting members for electrically connecting the processing units and the high-voltage board become complicated in shape. Considering that many connecting members are used for the electrical connection, the connecting members having complicated shapes is one of causes for cost increase.

SUMMARY OF THE INVENTION

An object of the present invention is to provide an image forming apparatus in which units and a high-voltage board can be electrically connected using simply shaped connecting members.

One aspect of the present invention is directed to an image forming apparatus, including a first unit for performing an image forming process on a sheet; a housing including a frame member having a first surface and a second surface opposite to the first surface, the first and second surface defining an accommodation space for accommodating the first unit; a second unit to be mounted on the second surface of the frame member to perform a predetermined operation as the image forming process is performed by the first unit; a high-voltage board to be mounted on the second surface of the frame member with the second unit located therebetween for supplying a high voltage to the first unit; and a connecting mechanism for electrically connecting the first unit and the high-voltage board to supply the high voltage to the first unit; wherein the connecting mechanism includes a unit-side wire member extending in the accommodation space and a board-side wire member connectable to the unit-side wire member and extending outside the accommodation space; the unit-side wire member includes a first end portion connectable to the first unit and a second end portion opposite to the first end portion; the board-side wire member includes a third end portion connectable to the high-voltage board and a fourth end portion opposite to the third end portion; one of the second and fourth end portions serves as a first contact with a biasing shape and the other serves as a second contact which can come into contact with the first contact; and the first contact is pressed into contact with the second contact while accumulating a biasing force when the unit-side wire member and the board-side wire member are connected.

Another aspect of the present invention is directed to an image forming apparatus, including a first unit for performing an image forming process on a sheet; a frame member having a first surface facing the first unit and a second surface opposite to the first surface; a second unit to be mounted on the second surface of the frame member; a high-voltage board to be mounted on the second surface of the frame member with the second unit located therebetween for supplying a high voltage to the first unit; and a connecting mechanism for electrically connecting the first unit and the high-voltage board to supply the high voltage to the first unit; wherein the connecting mechanism includes a unit-side wire member extending at a side of the first surface and a board-side wire member connectable to the unit-side wire member and extending at a side of the second surface; the unit-side wire member includes a first end portion connectable to the first unit and a second end portion opposite to the first end portion; the board-side wire member includes a third end portion connectable to the high-voltage board and a fourth end portion opposite to the third end portion; one of the second and fourth end portions serves as a first contact with a biasing shape and the other serves as a second contact which can come into contact with the first contact; and the first contact is pressed into contact with the second contact while accumulating a biasing force when the unit-side wire member and the board-side wire member are connected.

These and other objects, features and advantages of the present invention will become more apparent upon reading the following detailed description along with the accompanying drawings.

DETAILED DESCRIPTION OF THE PREFERRED EMBODIMENT

Figure 1A:
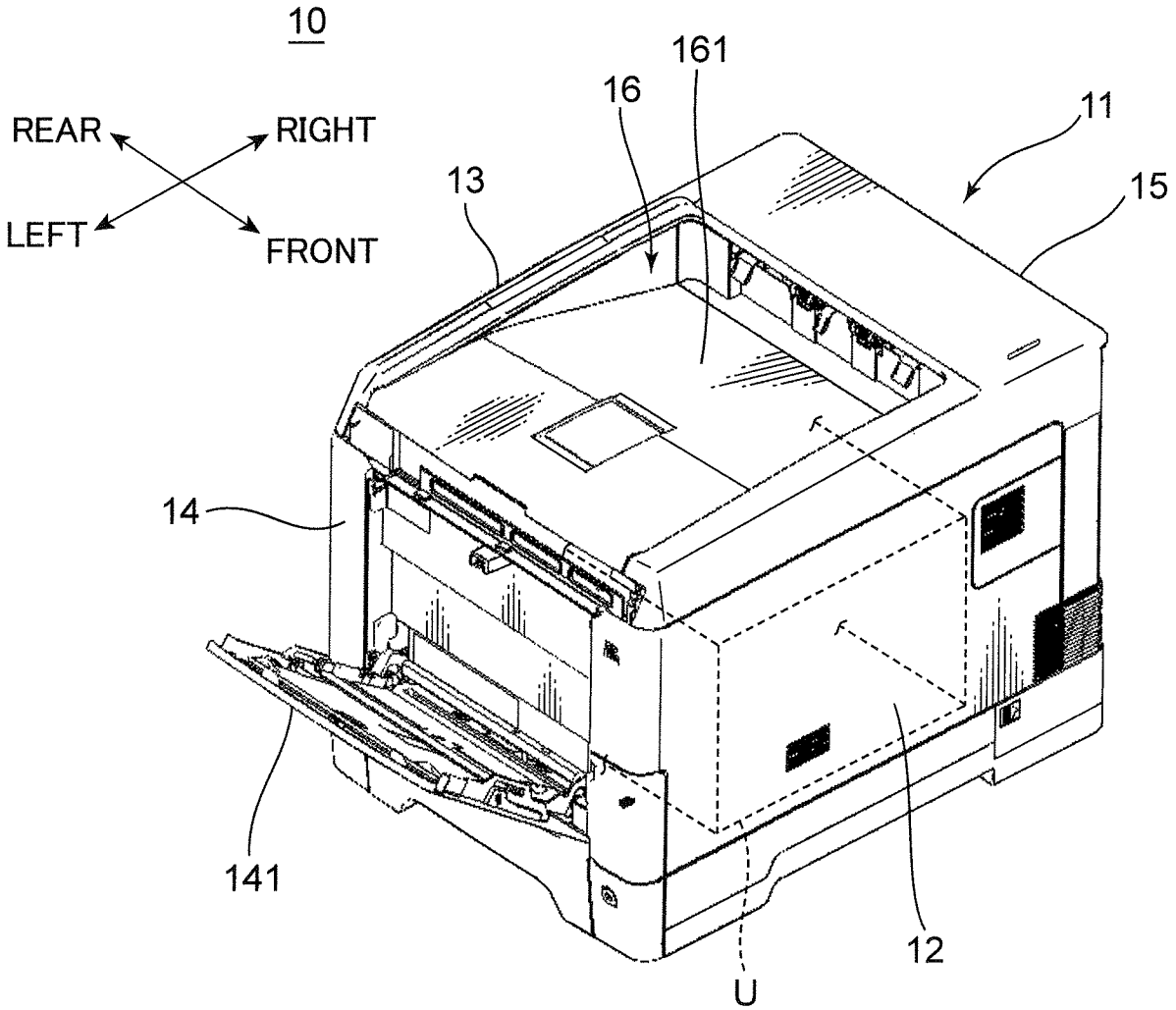
FIG. 1A is an external perspective view of an image forming apparatus according to one embodiment of the invention.

Hereinafter, one embodiment according to the present invention is described with reference to the drawings. FIG. 1A is an external perspective view of an image forming apparatus 10 according to this embodiment. The image forming apparatus 10 is, for example, a tandem color printer and includes a box-shaped housing 11. The housing 11 includes a front cover 12 covering the front surface, a rear cover 13 covering the rear surface, a right cover 15 covering the right surface and a left cover 14 covering the left surface, and these covers 12, 13, 14 and 15 constitute an external cover which determines an exterior design of the image forming apparatus.

A sheet discharge unit 16 to which a sheet is to be discharged is provided at a top part of the housing 11. The sheet discharge unit 16 is formed with a sheet discharge surface 161 onto which a sheet having an image formed thereon is to be discharged. Further, a manual feed tray 141 is openably and closably provided on the left cover 14. The manual feed tray 141 is also used as a part of the exterior cover that determines the exterior design of the image forming apparatus. Note that direction-indicating terms such as "upper", "lower", "left", "right", "front" and "back/rear" used in the following description are merely for clarifying the description and not of the nature to limit the present invention.

Figure 1B:
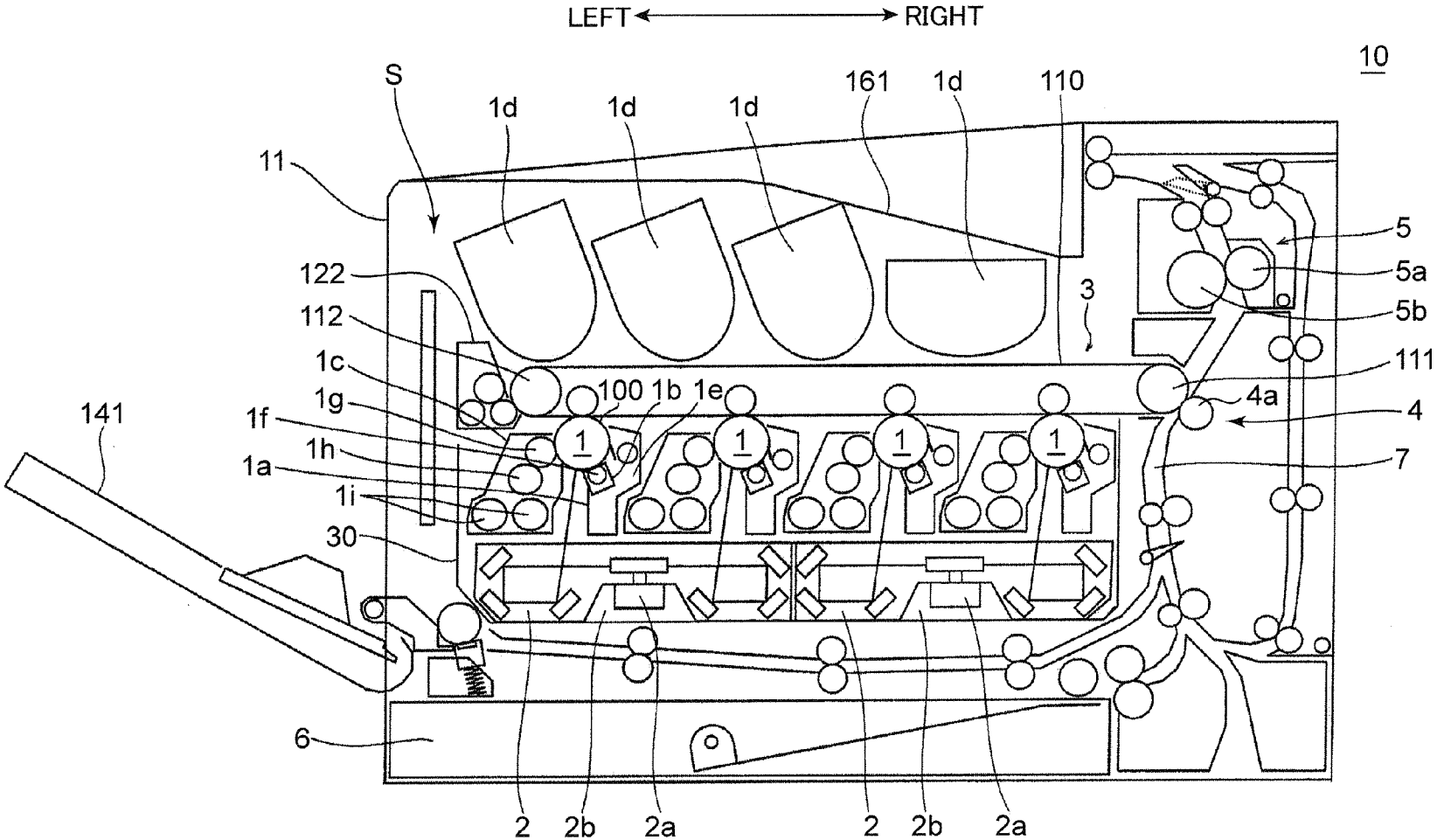
FIG. 1B is a sectional side view of the image forming apparatus.

FIG. 1B is a sectional side view of the image forming apparatus 10. The housing 11 is internally provided with a plurality of processing units U (first unit) for performing an image forming process on a sheet. In this embodiment, image forming units 1 for forming toner images on photoconductive drums 100 based on image information transmitted from an external apparatus such as a computer, optical scanning units 2 for forming electrostatic latent images on the circumferential surfaces of the photoconductive drums 100, an intermediate transfer unit 3 for primarily transferring toner images formed on the photoconductive drums 100, a secondary transfer unit 4 for transferring a toner image on the intermediate transfer unit 3 to a sheet, and a fixing unit 5 for fixing a toner image transferred to a sheet are provided as the processing units U in the housing 11. A sheet cassette 6 for storing a stack of sheets to which toner images are to be transferred, and a conveyance path 7 for conveying sheets from the sheet cassette 6 and the manual feed tray 141 described above are further provided in the housing 11.

The four image forming units 1 are arranged at specified intervals in a horizontal direction to form toner images of respective colors of black, magenta, cyan and yellow. Each image forming unit 1 includes a drum unit 1*a* with the photoconductive drum 100 for bearing an electrostatic latent image, a charger 1*b* for charging the circumferential surface of the photoconductive drum 100, a developing unit 1*c* for forming a toner image by attaching a developer to an electrostatic latent image, a corresponding one of black, magenta, cyan and yellow toner containers 1*d* for supplying toner of a specified color to the developing unit 1*c* and a cleaner 1*e* for removing the residual toner on the circumferential surface of the photoconductive drum 100.

The charger 1*b* includes a charging roller 1*f* which rotates in contact with the circumferential surface of the photoconductive drum 100. A charging bias is supplied to the charging roller 1*f*. The charger 1*b* and the cleaner 1*e* are integrally provided to the drum unit 1*a*. The developing unit 1*c* includes a sleeve roller 1*g* for supplying the toner to the circumferential surface of the photoconductive drum 100, a magnet roller 1*h* for supplying the toner to the circumferential surface of the sleeve roller 1*g* and two agitating rollers 1*i* for agitating the toner and carrier. Predetermined developing biases are respectively supplied to the sleeve roller 1*g* and the magnet roller 1*h*.

Two optical scanning units 2 are provided adjacent to each other. Each optical scanning unit 2 forms electrostatic latent images on the circumferential surfaces of the photoconductive drums 100 of the two adjacent image forming units 1 arranged above it by emitting beams of light based on image information. Thus, each optical scanning unit 2 includes a polygon unit 2*a*, which is rotated at a high speed by a motor, to scan the photoconductive drums 100 in an axial direction with beams of light.

The intermediate transfer unit 3 includes a transfer belt 110 which turns in contact with the circumferential surfaces of the respective photoconductive drums 100, a drive roller 111 and a driven roller 112 between which the transfer belt 110 is mounted, and primary transfer rollers 113 for pressing the transfer belt 110 against the respective photoconductive drums 100. Toner images on the photoconductive drums 100 are primarily transferred to the transfer belt 110. The toner images on the transfer belt 110 are secondarily transferred to a sheet by a secondary transfer roller 4*a* of the secondary transfer unit 4 arranged to face the drive roller 111. Toner residual on the circumferential surface of the transfer belt 110 without being transferred to the sheet is collected by a belt cleaner 122 arranged to face the driven roller 112.

The fixing unit 5 includes a pair of fixing rollers 5*a*, 5*b* and, while a sheet having a toner image transferred thereto passes between the fixing rollers 5*a* and 5*b*, the toner image is fixed to the sheet by heating. The sheet finished with a fixing process is discharged onto the sheet discharge surface 161.

The sheet discharge surface 161 provided on the upper surface of the housing 11 is so supported as to be openable upward and closable downward with an end thereof at the right cover 15 as a supporting point. When the sheet discharge surface 161 is opened upward, an upper side of an accommodation space S in the housing 11 is opened. The respective toner containers 1*d* can be removed through this opening. Further, in a state where the respective toner containers 1*d* are removed through the opening, the intermediate transfer unit 3 can be removed through this opening. The intermediate transfer unit 3 is horizontally supported by a first sheet-metal frame 21 and a second sheet-metal frame 22 with the axial center of the drive roller 111 positioned in the housing 11.

The intermediate transfer unit 3 can be removed through the opening above the accommodation space S when being inclined with a side toward the driven roller 112 lifted up. When the intermediate transfer unit 3 is removed from the accommodation space S, the drum units 1*a* and the developing units 1*c* of the respective image forming units 1 can be pulled upward and removed through the opening above the accommodation space S.

Figure 2:
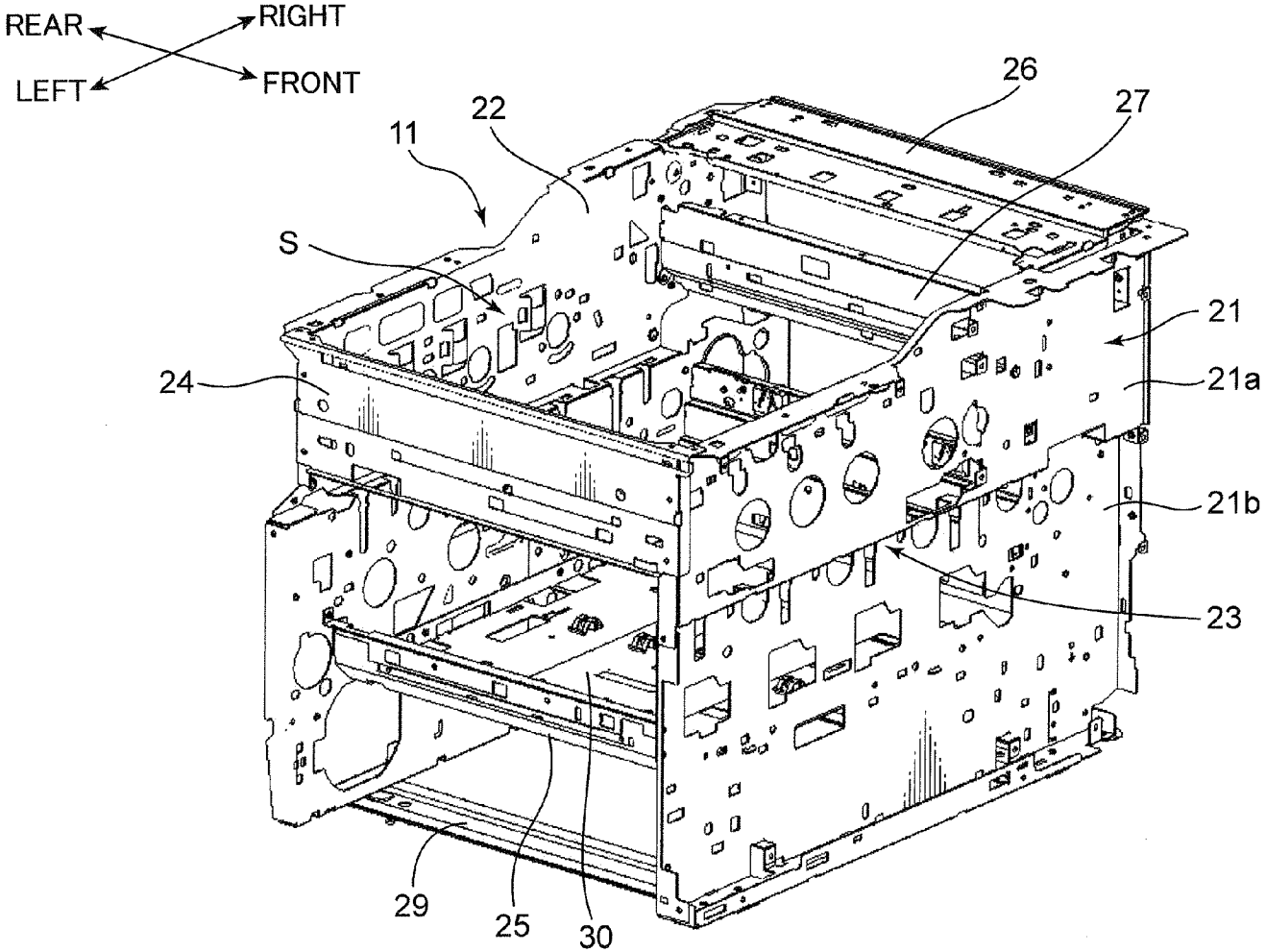
FIG. 2 is a perspective view showing a frame structure of a housing in a state where an exterior cover and peripheral parts are removed from the housing.

FIG. 2 is a perspective view showing a frame structure of the housing 11 in a state where the exterior cover and peripheral parts are removed from the housing 11. The housing 11 includes a frame member which defines the accommodation space S for accommodating the processing units U as described above. The frame member is made of a sheet-metal and includes the first sheet-metal frame 21 corresponding to the front surface of the housing 11 and the second sheet-metal frame 22 corresponding to the rear surface of the housing 11.

Each of the first and second sheet-metal frames 21, 22 has an inner surface (first surface) and an outer surface (second surface) opposite to the inner surface. The first and second sheet-metal frames 21, 22 stand in such a manner that the inner surfaces thereof face each other in forward and backward directions of the housing 11. The accommodation space S is defined by the inner surfaces of the first and second sheet-metal frames 21, 22, and the processing units are supported by the first and second sheet-metal frames 21, 22 in the accommodation space S.

The first sheet-metal frame 21 is composed of a pair of upper and lower frame parts 21*a*, 21*b* arranged one above the other in a vertical direction. The upper and lower frame parts 21*a*, 21*b* are displaced in forward and backward directions of the housing 11. Thus, a step 23 is formed between a lower edge portion of the upper frame part 21*a* and an upper edge portion of the lower frame part 21*b*. Further, a supporting plate 30 in the form of a flat plate for supporting the respective optical scanning units 2 from below is horizontally interposed between the first and second sheet-metal frames 21, 22.

The frame member further includes a plurality of coupling pieces made of a sheet-metal and coupling the first and second sheet-metal frames 21, 22 in forward and backward directions of the housing 11. In this embodiment, the coupling pieces include an upper coupling piece 24, a lower coupling piece 25 and a bottom coupling piece 29 on the left side of the housing 11. The upper coupling piece 24 couples an upper part of a left edge portion of the first sheet-metal frame 21 and that of a left edge portion of the second sheet-metal frame 22. The lower coupling piece 25 is located below the upper coupling piece 24 and couples a substantially middle part of the left edge portion of the first sheet-metal frame 21 and that of the left edge portion of the second sheet-metal frame 22. The bottom coupling piece 29 couples a bottom edge portion of the first sheet-metal frame 21 and that of the second sheet-metal frame 22 at the left side of the housing 11.

The coupling pieces also include, on the right side of the housing 11, a coupling piece 26 which couples an upper edge portion of the first sheet-metal frame 21 and that of the second sheet-metal frame 22 and a coupling piece 27 which couples the first and second frame parts 21, 22 at a position below the coupling piece 26.

Figure 3:
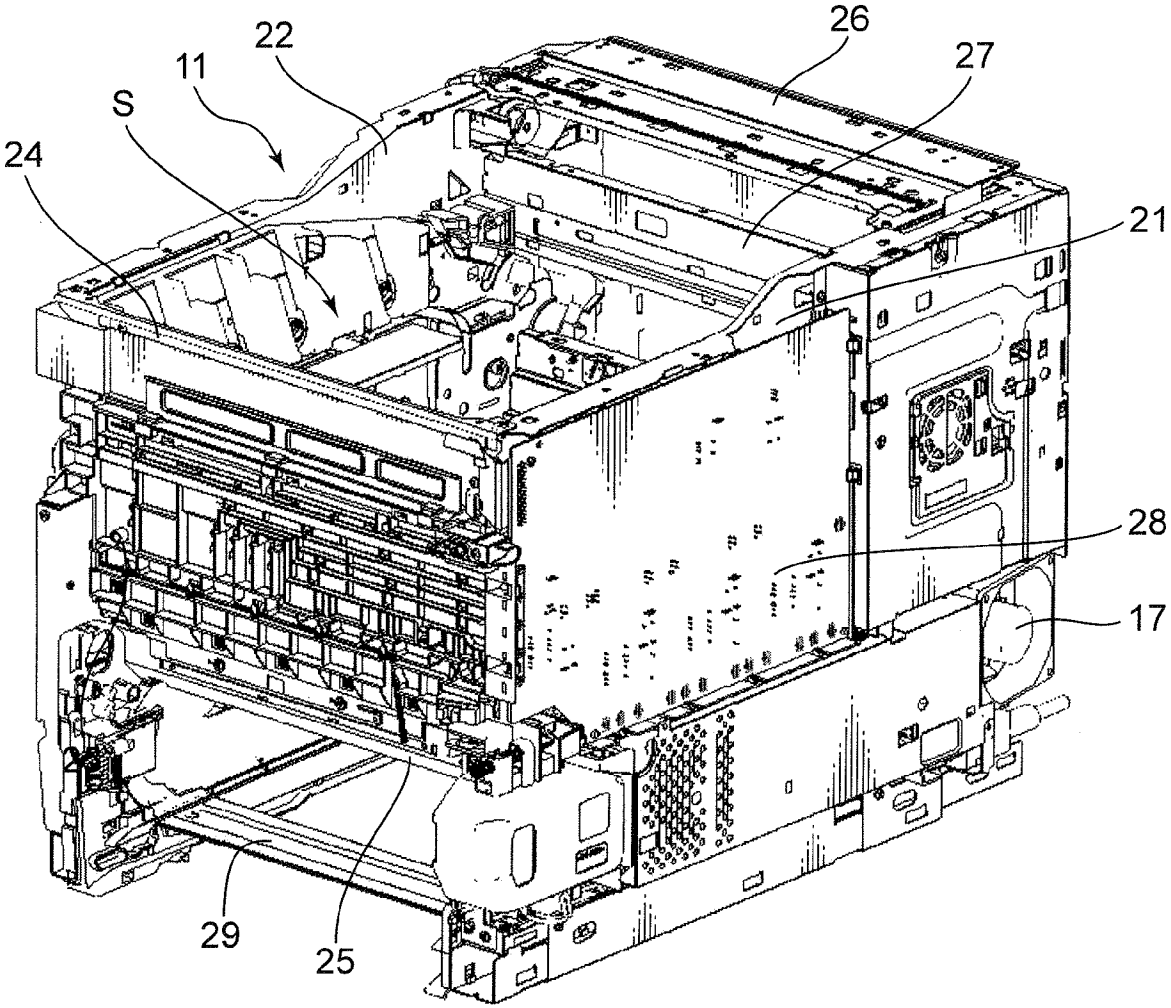
FIG. 3 is a perspective view of the housing showing a state where the peripheral parts are mounted on a frame member of the housing.
Figure 4:
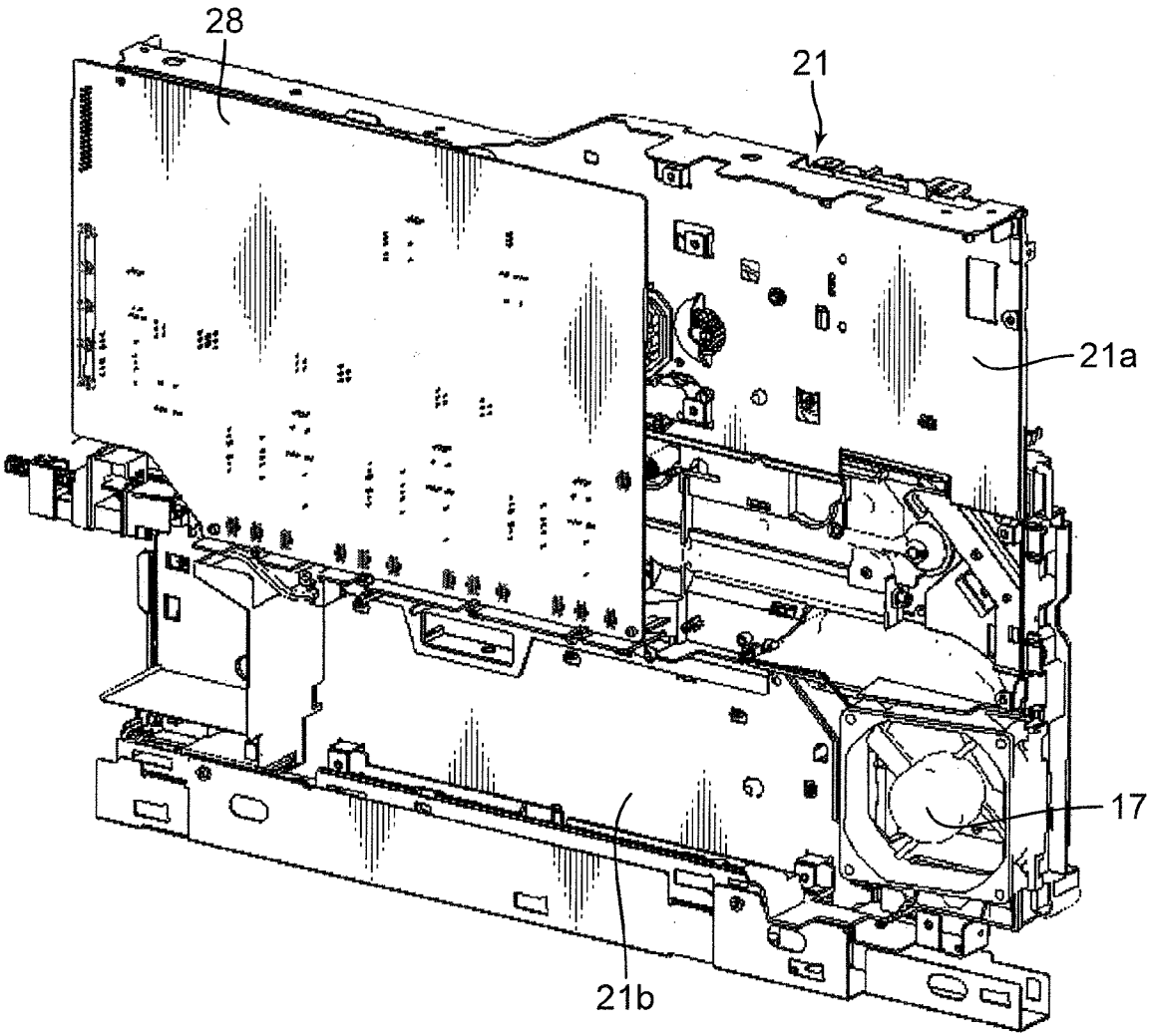
FIG. 4 is a perspective view of a first sheet-metal frame showing a state where the peripheral parts are mounted on the first sheet-metal frame.

FIG. 3 is a perspective view of the hosing 11 showing a state where the peripheral parts are mounted on the frame member of the housing 11 and FIG. 4 is a perspective view of the first sheet-metal frame 21 showing a state where the peripheral parts are mounted on the first sheet-metal frame 21. Various peripheral parts are mounted on the frame member. Here is shown an example in which a high-voltage board 28 for supplying high voltages to the processing units housed in the housing 11 is mounted on the outer surface of the first sheet-metal frame 21.

Various devices for power supply such as high-voltage semiconductor devices and transducers are mounted on a part mounting surface of the high-voltage board 28. Further, an exhaust fan 17 for exhausting heat generated in the housing 11 to the outside is arranged at an oblique lower position of the high-voltage board 28.

Figure 5:
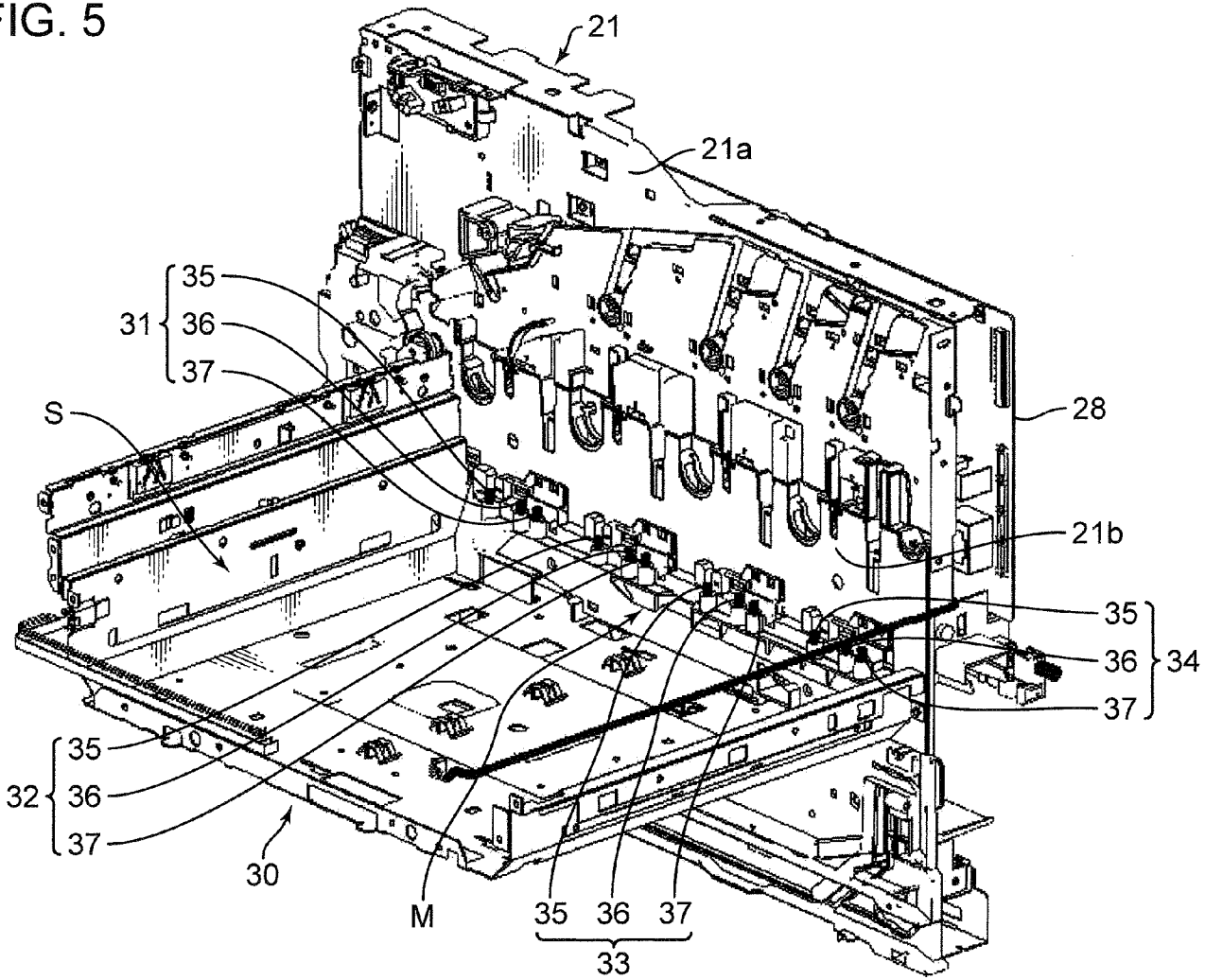
FIG. 5 is a perspective view of the first sheet-metal frame having a high-voltage board mounted thereon when viewed from an accommodation space of the housing.
Figure 6:
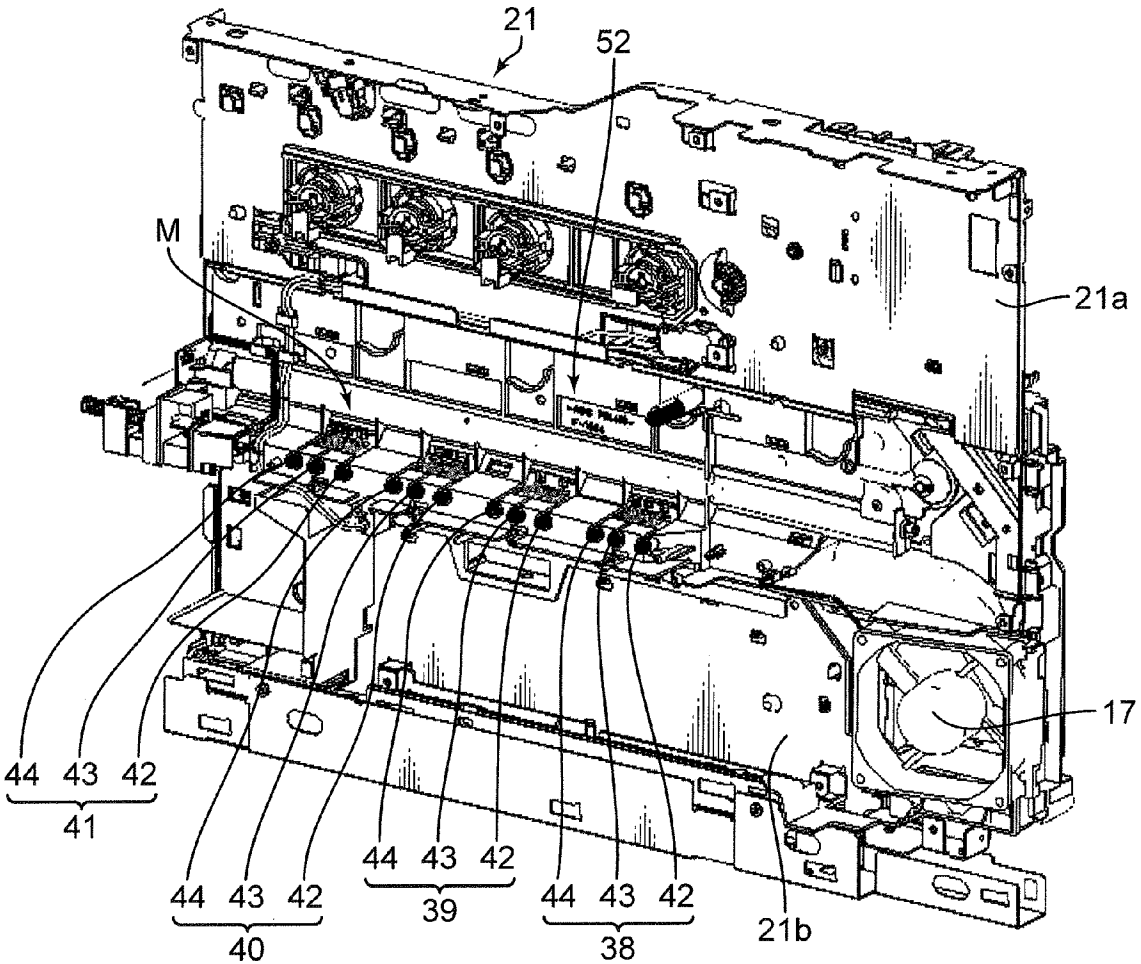
FIG. 6 is a perspective view showing a state where the high-voltage board is removed from the first sheet-metal frame.

FIG. 5 is a perspective view of the first sheet-metal frame 21 having the high-voltage board 28 mounted thereon when viewed from the accommodation space S of the housing 11 and FIG. 6 is a perspective view showing a state where the high-voltage board 28 is removed from the first sheet-metal frame 21. A connecting mechanism M for electrically connecting the high-voltage board 28 and the processing units is mounted on the first sheet-metal frame 21. The high-voltage board 28 can supply high voltages to the respective processing units U by being electrically connected to the processing units U by the connecting mechanism M.

The connecting mechanism M includes first to fourth output-side contact groups 31, 32, 33 and 34 arranged along the first sheet-metal frame 21 in the accommodation space S and provided in correspondence with the respective image forming units 1 and first to fourth input-side contact groups 38, 39, 40 and 41 arranged along the first sheet-metal frame 21 outside the accommodation space S. The first output-side contact group 31 corresponds to the first input-side contact group 38, the second output-side contact group 32 to the second input-side contact group 39, the third output-side contact group 33 to the third input-side contact group 40 and the fourth output-side contact group 34 to the fourth input-side contact group 41.

Each of the output-side contact groups 31, 32, 33 and 34 includes a plurality of (three in this embodiment) output-side contacts 35, 36 and 37 for supplying biases to the charging roller 1*f* of the charger 1*b* and the sleeve roller 1*g* and the magnet roller 1*h* of the developing unit 1*c* of the corresponding image forming unit 1. Each of the input-side contact group 38, 39, 40 and 41 includes a plurality of (three in this embodiment) input-side contacts 42, 43 and 44. The input-side contacts 42, 43 and 44 and the output-side contacts 35, 36 and 37 corresponding thereto are connectable to each other via unillustrated through holes formed in the first sheet-metal frame 21.

Specifically, in the respective output-side contact groups 31, 32, 33 and 34 and the input-side contact groups 38, 39, 40 and 41 corresponding thereto, the output-side contacts 35 are connectable to the input-side contacts 42, the output-side contacts 36 to the input-side contacts 43 and the output-side contacts 37 to the input-side contacts 44. The output-side contacts 35, 36 and 37 are connectable to contacts of unillustrated units provided in the processing units, and the input-side contacts 42, 43 and 44 are connectable to board contacts 49, 50 and 51 provided on the high-voltage board 28 to be described later.

Figure 7:
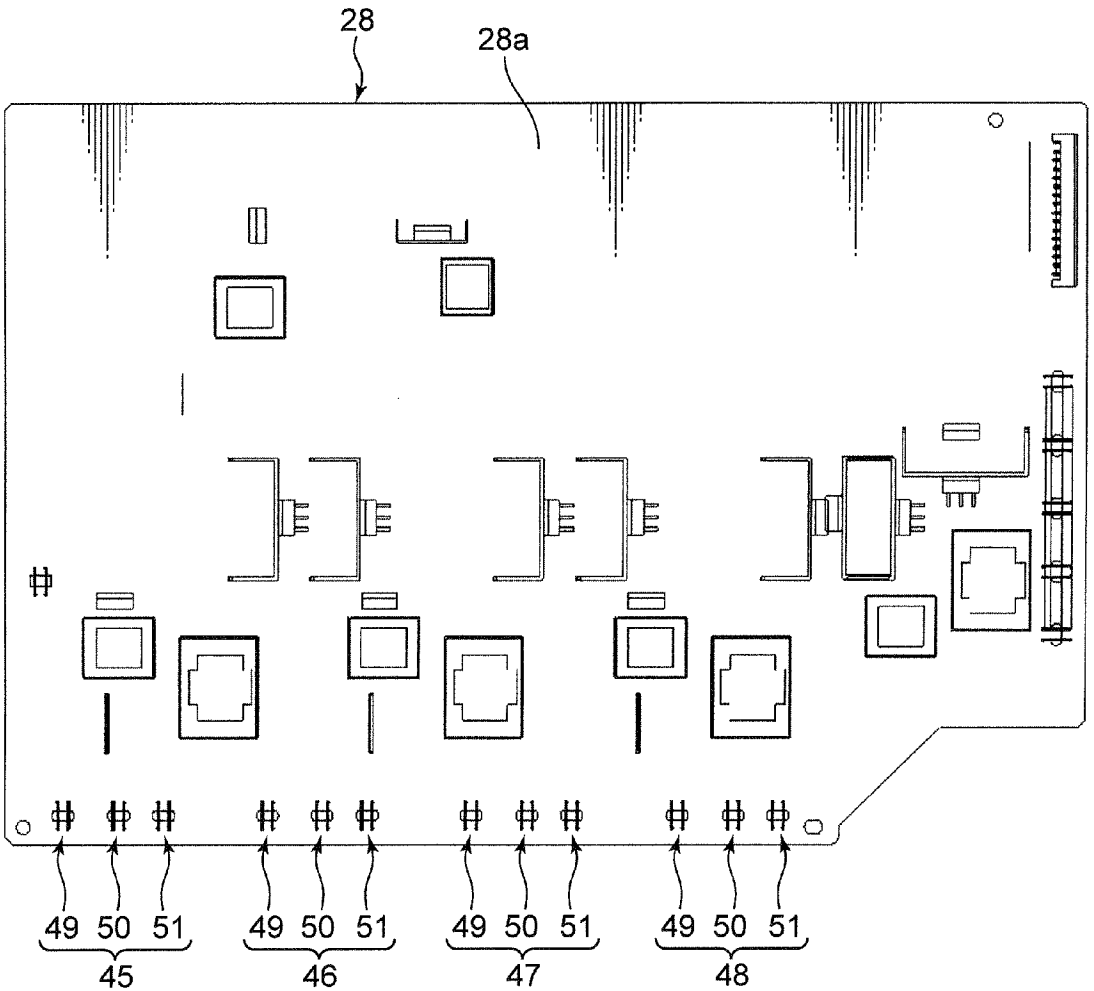
FIG. 7 is a plan view of the high-voltage board showing a part mounting surface of the high-voltage board.

FIG. 7 is a plan view of the high-voltage board 28 showing a mounting surface 28*a* thereof. The high-voltage board 28 has the mounting surface 28*a* on which various parts such as electronic devices are to be mounted. The mounting surface 28*a* is a surface facing the first sheet-metal frame 21 with the high-voltage board 28 fixed to the first sheet-metal frame 21. First to fourth board contact groups 45, 46, 47 and 48 are provided on the mounting surface 28*a* along its lower edge portion in correspondence with the first to fourth input-side contact groups 38, 39, 40 and 41. Specifically, the first board contact group 45 corresponds to the first input-side contact group 38, the second board contact group 46 to the second input-side contact group 39, the third board contact group 47 to the third input-side contact group 40 and the fourth board contact group 48 to the fourth input-side contact group 41.

Each of the board contact groups 45, 46, 47 and 48 includes a plurality of (three in this embodiment) board contacts 49, 50 and 51. In the respective board contact groups 45, 46, 47 and 48 and the input-side contact groups 38, 39, 40 and 41 corresponding thereto, the board contacts 49 are connectable to the input-side contacts 42, the board contacts 50 to the input-side contacts 43 and the board contacts 51 to the input-side contacts 44. The respective board contacts 49, 50 and 51 are formed by jumper wires soldered to the mounting surface 28*a*. Accordingly, when the input-side contacts 42, 43 and 44 of the connecting mechanism M are connected to the board contacts 49, 50 and 51 of the high-voltage board 28 and the output-side contacts 35, 36 and 37 are connected to unit contacts of the drum units 1*a* and the developing units 1*c*, high voltages can be supplied from the high-voltage board 28 to the charging rollers 1*f*, the sleeve rollers 1*g* and the magnet rollers 1*h*.

Referring back to FIG. 6, a second unit 52 extending along the step 23 (FIG. 2) outside the accommodation space S is arranged on the upper edge portion of the lower frame part 21*b* of the first sheet-metal frame 21. The second unit 52 is for performing a predetermined operation as an image forming process is performed by the processing units. In this embodiment, the second unit is a waste toner unit 52 which conveys waste toner, which was not used in an image forming process performed on a sheet, to a waste toner container (not shown).

In this embodiment, the waster toner unit 52 is arranged on the upper edge portion of the lower frame part 21*b*. Thus, the high-voltage board 28 is mounted on the first sheet-metal frame 21 with the waste toner unit 52 therebetween. In other words, the waste toner unit 52 is interposed between the high-voltage board 28 and the processing units. Thus, the construction of the connecting mechanism M, specifically, a construction for connecting the input-side contacts 42, 43 and 44 and the output-side contacts 35, 36 and 37 tends to become complicated. However, in this embodiment, the input-side contacts 42, 43 and 44 and the output-side contacts 35, 36 and 37 are connected by a simple construction described below.

Figure 8:
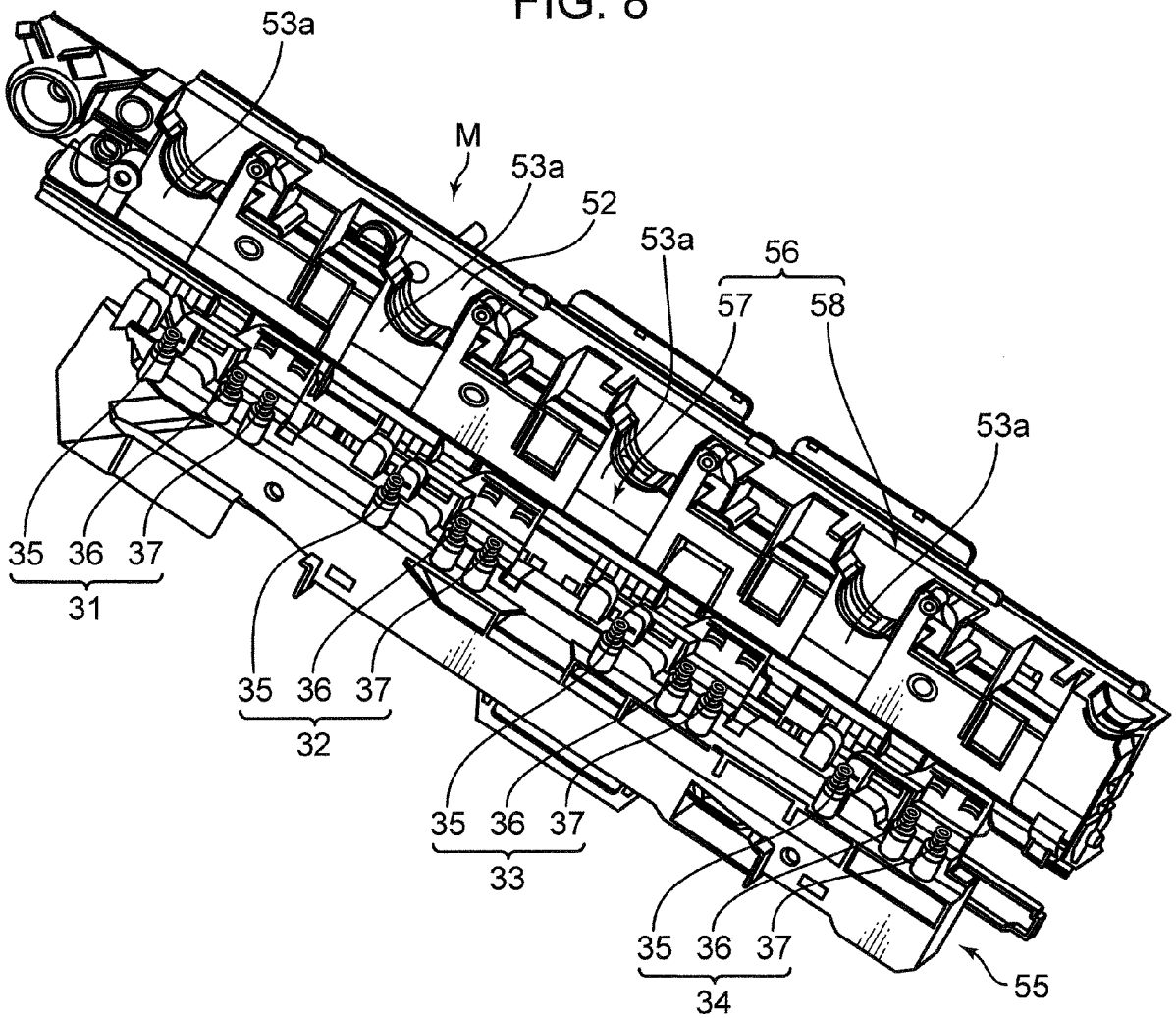
FIG. 8 is a perspective view of a connecting mechanism when viewed from the accommodation space.
Figure 9:
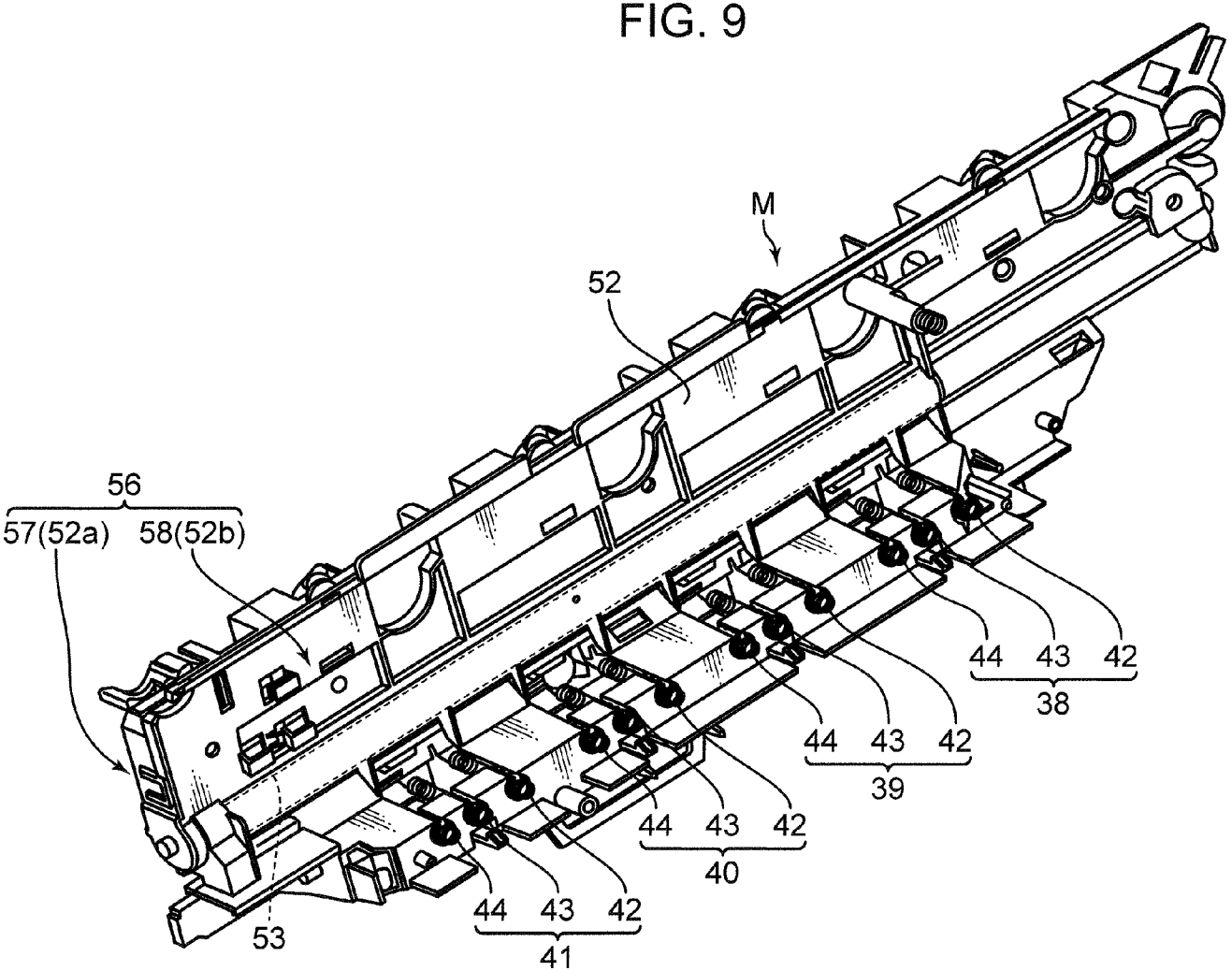
FIG. 9 is a perspective view of the connecting mechanism when viewed from the outside of the accommodation space.

FIG. 8 is a perspective view of the connecting mechanism M when viewed from the accommodation space S and FIG. 9 is a perspective view of the connecting mechanism M when viewed from the outside of the accommodation space S, i.e. from the high-voltage board 28. The connecting mechanism M includes a unit-side holding member 55 made of resin and adapted to hold wire members formed with the output-side contacts 35, 36 and 37 described above and a board-side holding member 56 made of resin and adapted to hold wire members formed with the input-side contacts 42, 43 and 44 described above. These members 55, 56 have an electrically insulating property since being made of resin. The board-side holding member 56 includes a first holding member 57 located at a side of the unit-side holding member 55 and a second holding member 58 assembled with the first holding member 57. In this embodiment, out of the first and second holding members 57, 58, the second holding member 58 holds the input-side contacts 42, 43 and 44.

Although the lower frame part 21*b* is located between the unit-side holding member 55 and the board-side holding member 56, it is not shown in FIG. 8 for clear representation of the drawing. The unit-side holding member 55 is mounted on the first holding member 57 via the lower frame part 21*b*. Thus, the unit-side holding member 55 is a member arranged in the accommodation space S and the board-side holding member 56 is a member arranged outside the accommodation space S.

Figure 10:
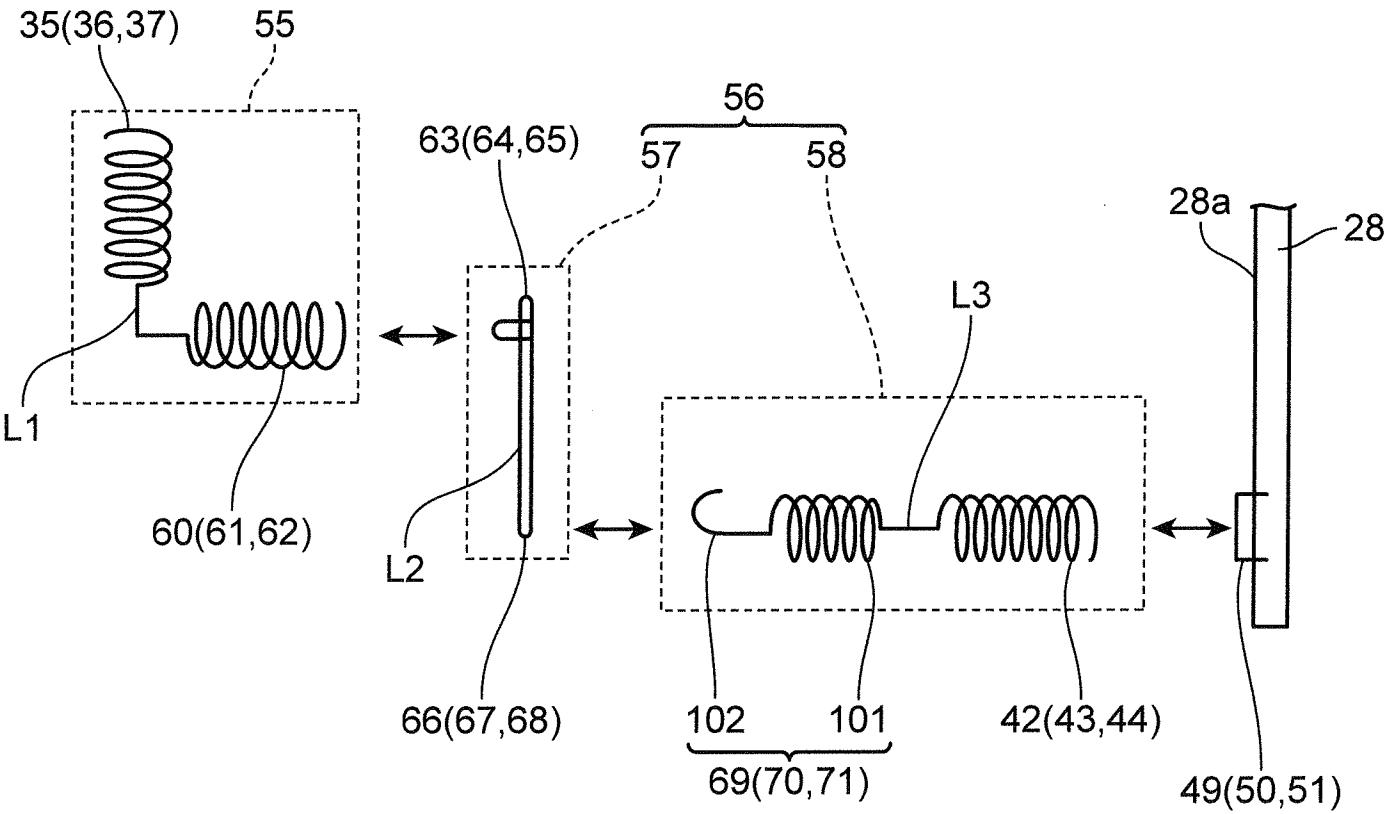
FIG. 10 is a diagram showing an arrangement construction of a wire material held by a unit-side holding member and that of wire members held by a board-side holding member.

Next, arrangement constructions of the wire members held by the unit-side holding member 55 and the board-side holding member 56 are described with reference to FIG. 10. FIG. 10 is a diagram showing the arrangement construction of the wire members held by the unit-side holding member 55 and that of the wire members held by the board-side holding member 56.

The unit-side holding member 55 holds 12 first wire members L1 in correspondence with 12 output-side contacts 35, 36 and 37. The respective first wire members L1 extend in the accommodation space S while being held by the unit-side holding member 55. The first wire members L1 are flexible metal wires and not covered by insulators made of resin or the like. The output-side contacts 35, 36 and 37 are formed at one end portions (first end portions) of the respective first wire members L1. The respective output-side contacts 35, 36 and 37 are coiled contacts and can generate biasing forces. First contacts 60, 61 and 62 are formed at the other end portions (second end portions) of the respective first wire members L1 opposite to the first end portions. The first contacts 60, 61 and 62 have a biasing shape capable of accumulating a biasing force. Specifically, the first contacts 60, 61 and 62 are coiled similar to the output-side contacts 35, 36 and 37.

The first holding member 57 of the board-side holding member 56 holds 12 second wire members L2 (first board-side wire members) in correspondence with 12 first contacts 60, 61 and 62. The second wire members L2 extend outside the accommodation space S while being held by the first holding member 57. The second wire members L2 are metal wires and not covered by insulators made of resin or the like. Second contacts 63, 64 and 65 which can come into contact with the first contacts 60, 61 and 62 are formed at one end portions (fifth end portions) of the second wire members L2. Further, third contacts 66, 67 and 68 are formed at the other end portions (sixth end portions) of the second wire members L2 opposite to the fifth end portions. Note that the second contacts 63, 64 and 65 may be formed to be coiled contacts instead of the first contacts 60, 61 and 62.

The second holding member 58 of the board-side holding member 56 holds 12 third wire members L3 (second board-side wire members) in correspondence with 12 third contacts 66, 67 and 68. The third wire members L3 extend outside the accommodation space S while being held by the second holding member 58. The third wire members L3 are flexible metal wires and not covered by insulators made of resin or the like. The corresponding input-side contacts 42, 43 and 44 are formed at one end portions (seventh end portions) of the third wire members L3. The input-side contacts 42, 43 and 44 are coiled contacts and can generate biasing forces. Further, fourth contacts 69, 70 and 71 shaped to be lockable to the third contacts 66, 67 and 68 are formed at the other end portions (eighth end portions) of the third wire members L3 opposite to the seventh end portions.

The second wire members L2 held by the first holding member 57 and the third wire members L3 held by the second holding member 58 constitute the board-side wire members extending outside the accommodation space S. The above input-side contacts 42, 43 and 44 are formed at one end portions (third end portions) of the board-side wire members and the above second contacts 63, 64 and 65 are formed at the other end portions (fourth end portions) thereof.

Specific structures of the unit-side holding member 55 and the board-side holding member 56 are described below.

Figure 11:
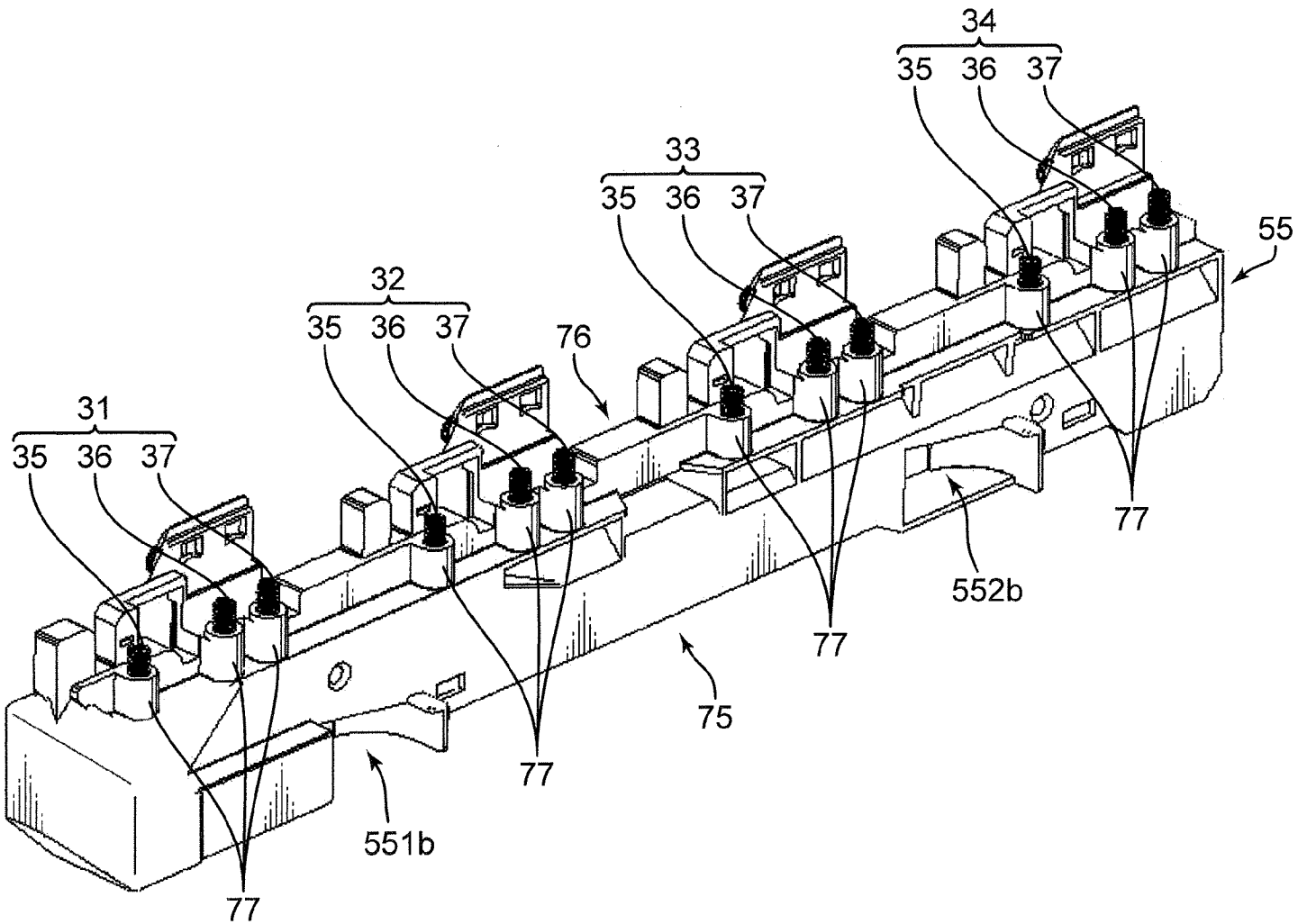
FIG. 11 is a perspective view of the unit-side holding member when viewed from the accommodation space.
Figure 12:
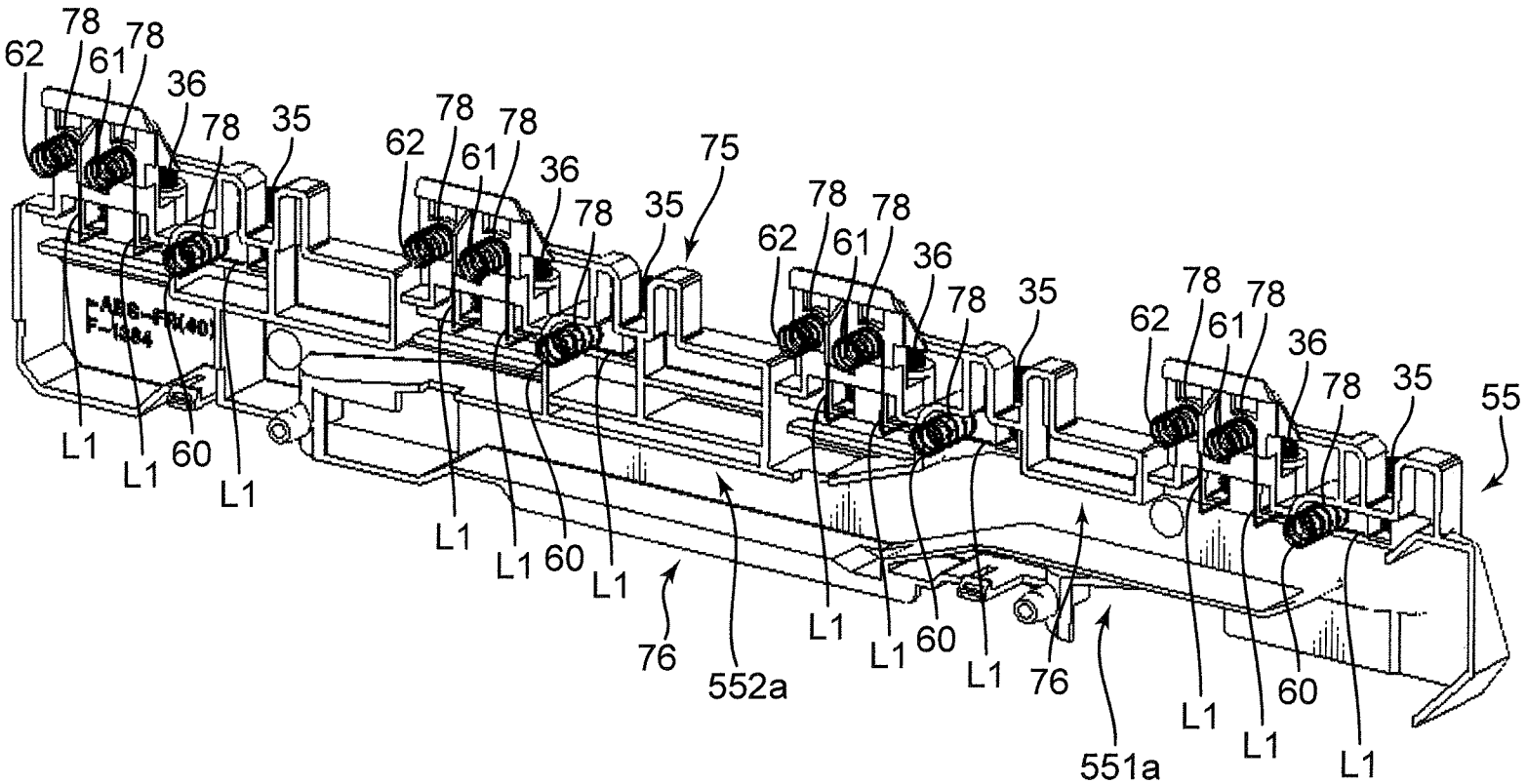
FIG. 12 is a perspective view of the unit-side holding member when viewed from the board-side holding member.

First, the specific structure of the unit-side holding member 55 is described with reference to FIGS. 11 and 12. FIG. 11 is a perspective view of the unit-side holding member 55 when viewed from the accommodation space S and FIG. 12 is a perspective view of the unit-side holding member 55 when viewed from the board-side holding member 56. The unit-side holding member 55 is a long and narrow member extending in a lateral direction of the housing 11 along the inner surface of the lower frame part 21*b* of the first sheet-metal frame 21 and includes a front surface portion 75 facing the accommodation space S and a rear surface portion 76 located opposite to the front surface portion 75 and facing the board-side holding member 56. The unit-side holding member 55 holds 12 first wire members L1 from the front surface portion 75 to the rear surface portion 76.

12 bosses 77 for holding the respective output-side contacts 35, 36 and 37 of the first to fourth output-side contact groups 31, 32, 33 and 34 are provided on the front surface portion 75. The bosses 77 are tubular members extending substantially in the vertical direction and arranged at predetermined intervals from each other. The respective output-side contacts 35, 36 and 37 are held to extend substantially in the vertical direction in the corresponding bosses 77, and leading end portions thereof (leading end portions of the first end portions) are exposed to the outside. Note that the first to fourth output-side contact groups 31, 32, 33 and 34 correspond to the image forming unit for black toner, that for cyan toner, that for yellow toner and that for magenta toner. The output-side contacts 35 are connected to the contacts of the drum units, and the output-side contacts 36, 37 are connected to the contacts of the developing units.

12 projections 78 for holding the first contacts 60, 61 and 62 of the respective first wire members L1 are provided on the rear surface portion 76. The projections 78 are arranged at predetermined intervals from each other and extend substantially in the vertical direction. The first contacts 60, 61 and 62 are fitted on the outer peripheries of the projections 78. Parts of the first wire members L1 between the output-side contacts 35, 36 and 37 and the first contacts 60, 61 and 62 are arranged in a predetermined direction in the unit-side holding member 55.

The rear surface portion 76 is formed with a first ventilation path 551*a* extending up to a position between the first output-side contact group 31 and the second output-side contact group 32 and a second ventilation path 552*a* extending up to a position between the third output-side contact group 33 and the fourth output-side contact group 34 from an end portion where the first output-side contact group 31 is formed. Downstream ends of the first and second ventilation paths 551*a*, 552*a* serve as openings 551*b*, 552*b* which are open toward the front surface portion 75. The first and second ventilation paths 551*a*, 552*a* are for introducing part of air blown by the fan 17 shown in FIG. 4 into the accommodation space S of the housing 11 through the openings 551*b*, 552*b* at the downstream ends.

The openings 551*b*, 552*b* are formed to face the arrangement positions of the polygon units 2*a* of the optical scanning units 2 when the housing 11 is viewed from front. As shown in FIG. 1B, the bottom surface of each optical scanning unit 2 is formed with a recess 2*b* extending in forward and backward directions near a lateral central part. The ventilation paths are formed by the supporting member 30 and the recesses 2*b*. The polygon units 2*a* are provided such that the motors for driving and rotating polygon mirrors are exposed in the recesses 2*b*. Accordingly, air blown through the openings 551*b*, 552*b* flows in the recesses 2*b* to cool the motors of the polygon units 2*a*.

Figure 13:
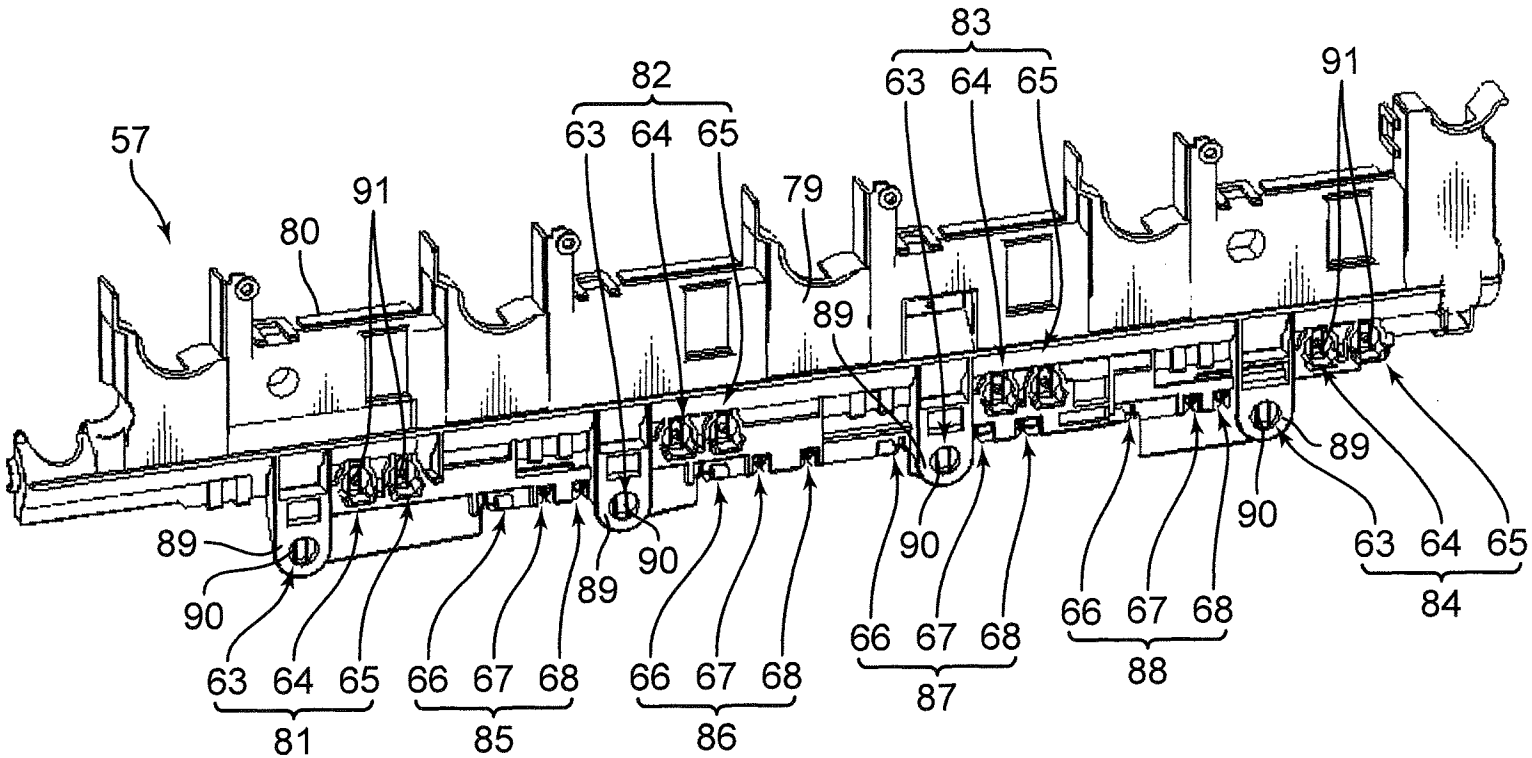
FIG. 13 is a perspective view of a first holding member when viewed from the unit-side holding member.
Figure 14:
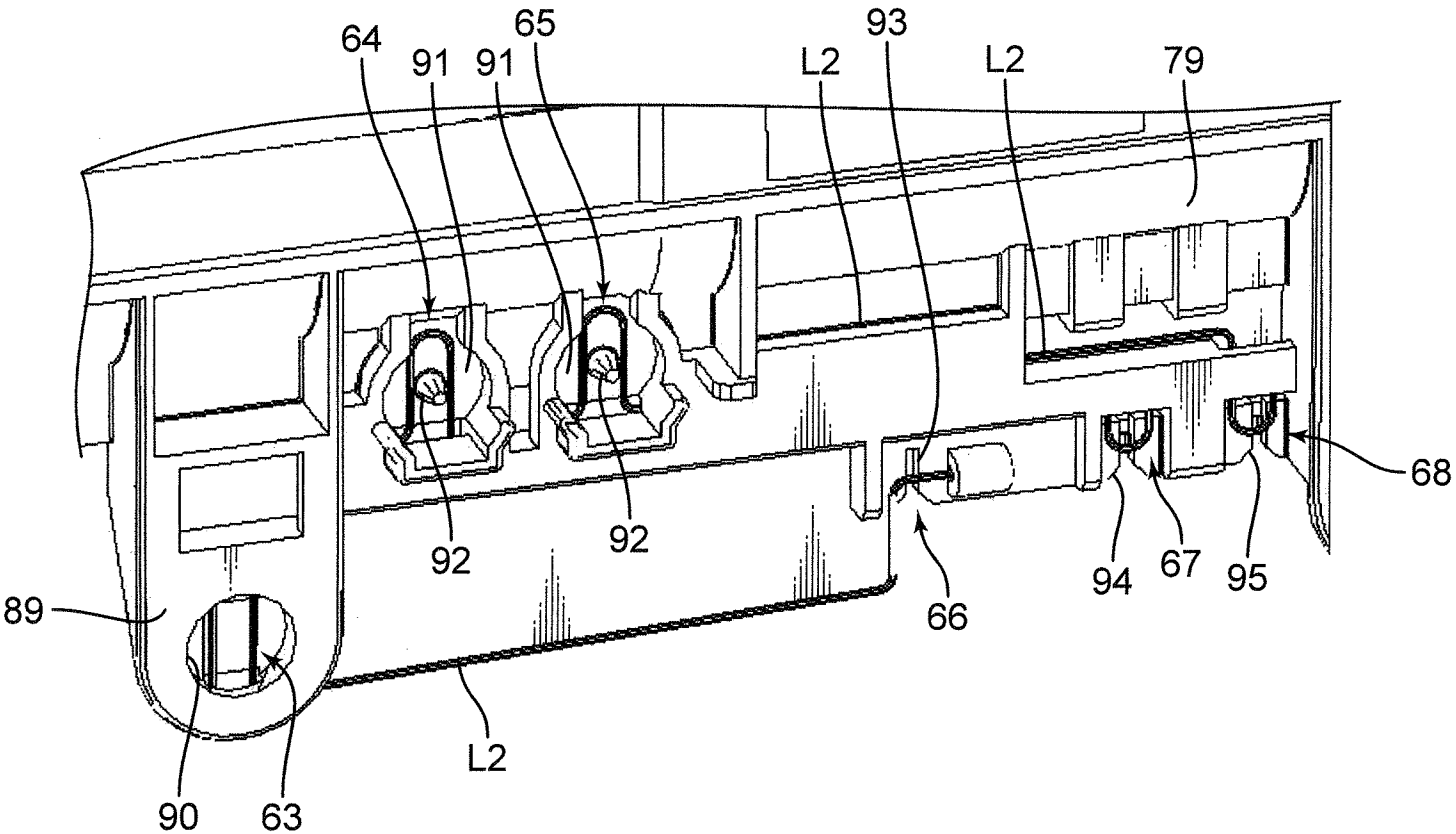
FIG. 14 is an enlarged perspective view showing second contacts and third contacts of the first holding member.
Figure 15:
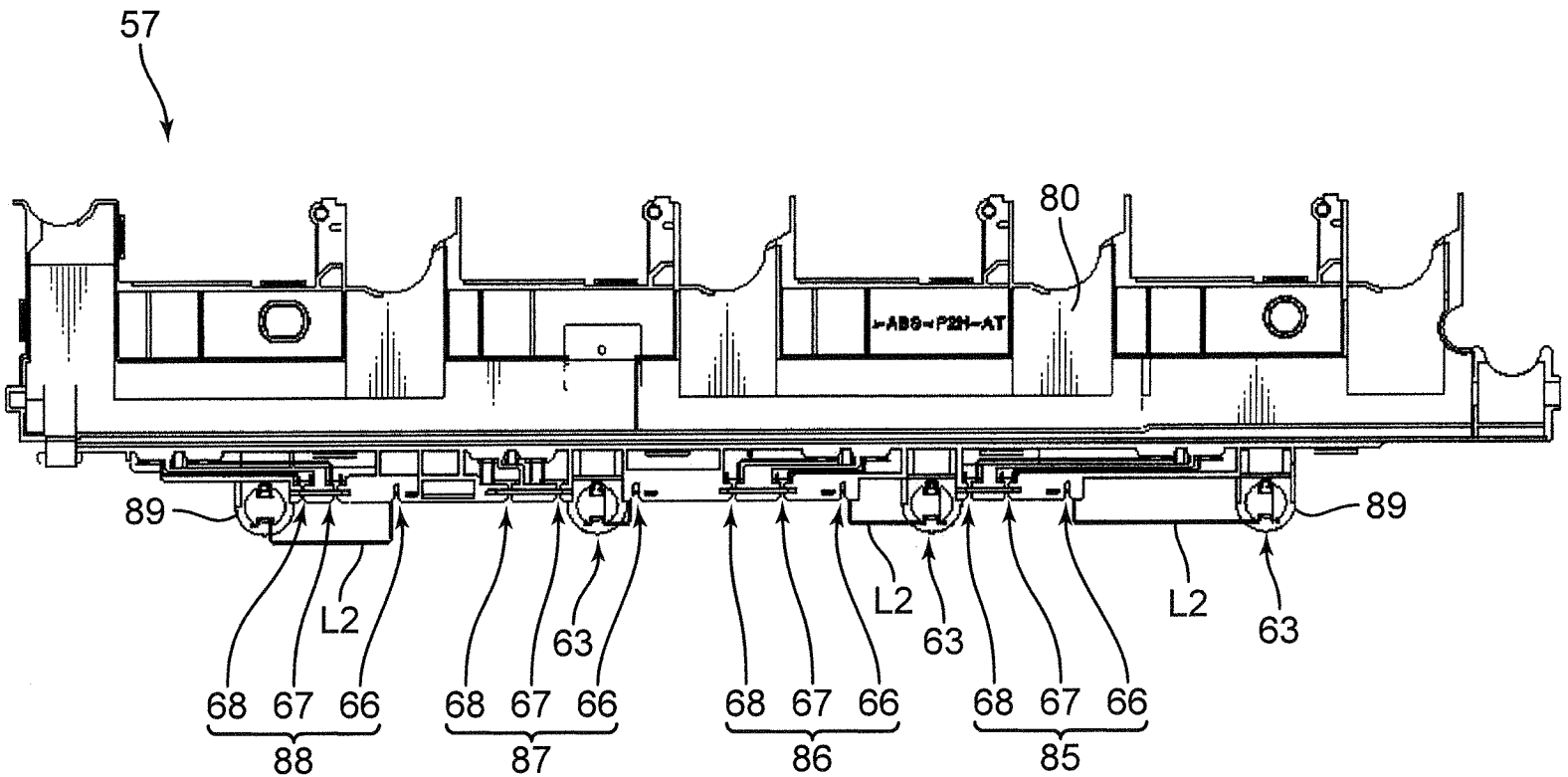
FIG. 15 is a front view of the first holding member when viewed from the second holding member.
Figure 16:
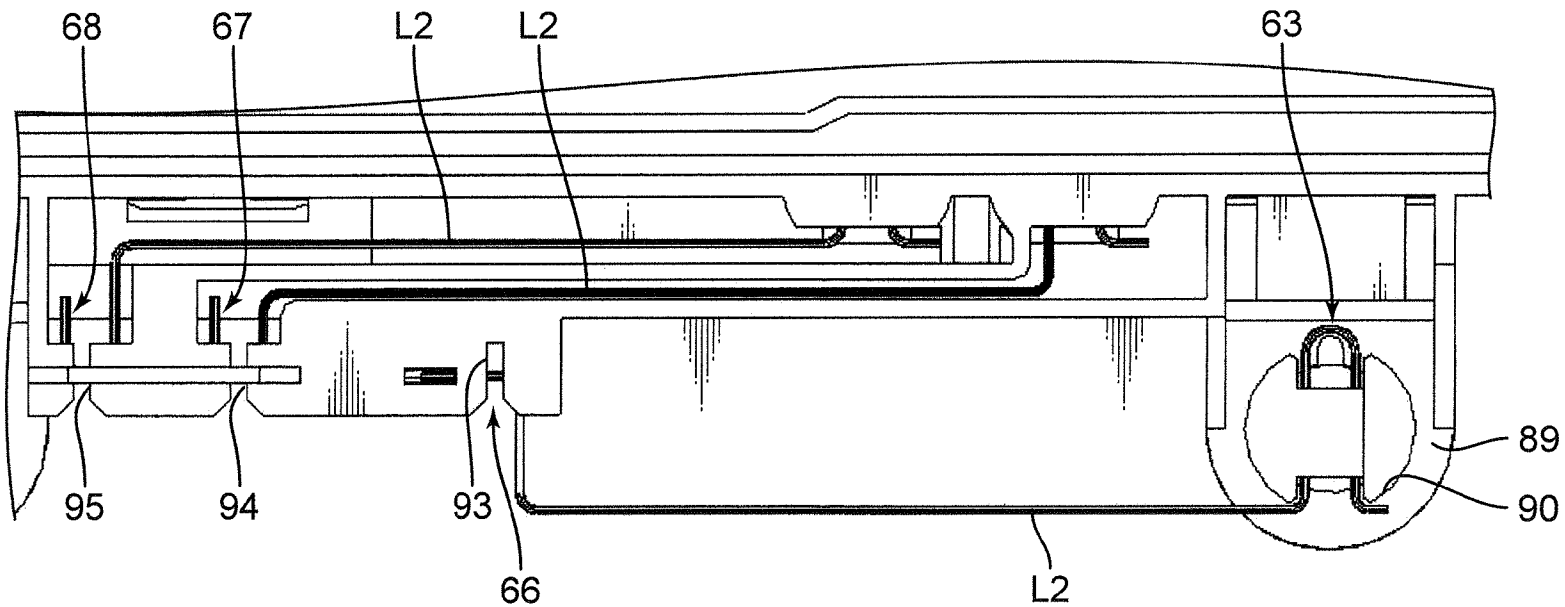
FIG. 16 is a front view showing the third contacts of the first holding member.

Next, the specific structure of the first holding member 57 of the board-side holding member 56 is described with reference to FIGS. 13 to 16. FIG. 13 is a perspective view of the first holding member 57 when viewed from the unit-side holding member 55. FIG. 14 is an enlarged perspective view showing the second contacts 63, 64 and 65 and the third contacts 66, 67 and 68 of the first holding member 57. FIG. 15 is a front view of the first holding member 57 when viewed from the second holding member 58. FIG. 16 is a front view showing the third contacts 66, 67 and 68 of the first holding member 57.

The first holding member 57 is a long and narrow plate-like member extending in the lateral direction of the housing 11 along the outer surface of the lower frame part 21*b* of the first sheet-metal frame 21 and has a first surface 79 facing the unit-side holding member 55 and a second surface 80 located opposite to the first surface 79 and facing the second holding member 58.

The first holding member 57 is for holding 12 second wire members L2 as described above and also holding four second contact groups 81, 82, 83 and 84 each group composed of three second contacts 63, 64 and 65 and corresponding to the respective first to fourth output-side contact groups 31, 32, 33 and 34 and four third contact groups 85, 86, 87 and 88 each group composed of three third contacts 66, 67 and 68 and corresponding to the second contact groups 81, 82, 83 and 84.

The first holding member 57 includes four hanging pieces 89 hanging down from a lower edge portion extending in a longitudinal direction. The hanging pieces 89 are arranged at predetermined intervals from each other and include through holes 90 perforated in a direction from the first surface 79 to the second surface 80. The second contacts 63 of the respective second contact groups are so fixed as to cross the through holes 90 of the corresponding hanging pieces 89. The second contacts 63 are formed by bending the fifth end portions of the second wire members L2 in U-shape.

Two adjacent recesses 91 are formed at a position near each hanging piece 89. The second contacts 64, 65 of the respective second contact groups are provided in the corresponding recesses 91. The second contacts 64, 65 are formed by bending the fifth ends of the second wire members L2 in U-shape similar to the second contacts 63. Projections 92 are provided in the recesses 91 and the U-shaped second contacts 64, 65 are fixed in the recesses 91 while tightly holding the projections 92 utilizing their elasticity.

The third contact groups 85, 86, 87 and 88 are provided on the lower edge portion of the first holding member 57 at predetermined intervals in the longitudinal direction. Since the respective third contact groups 85, 86, 87 and 88 basically have the same shape, only the third contact group 85 is described here as a representative. The third contacts 66, 67 and 68 are provided along the lower edge portion of the first holding member 57. As described above with reference to FIG. 10, the third contact 66 is formed at the sixth end portion of the second wire member L2 formed with the second contact 63, the third contact 67 is formed at the sixth end portion of the second wire member L2 formed with the second contact 64 and the third contact 68 is formed at the sixth end portion of the second wire member L2 formed with the second contact 65.

The first holding member 57 includes, on the lower edge portion, slits 93, 94 and 95 cut substantially in the vertical direction and corresponding to the respective third contacts 66, 67 and 68. The third contact 66 is so arranged as to cross the slit 93 at a side of the first surface 79 of the first holding member 57. The third contacts 67, 68 are formed by bending the sixth end portions of the second wire members L2 in U-shaped and curved portions thereof are so arranged as to cross the slits 94, 95 at the side of the first surface 79 of the first holding member 57.

Note that parts of the second wire members L2 between the second contact 63 and the third contact 66 extend below the lower edge portion of the first holding member 57. Further, parts of the second wire members L2 between the second contacts 64, 65 and the third contacts 67, 68 extend at a side of the second surface 80 of the first holding member 57.

Figure 17:
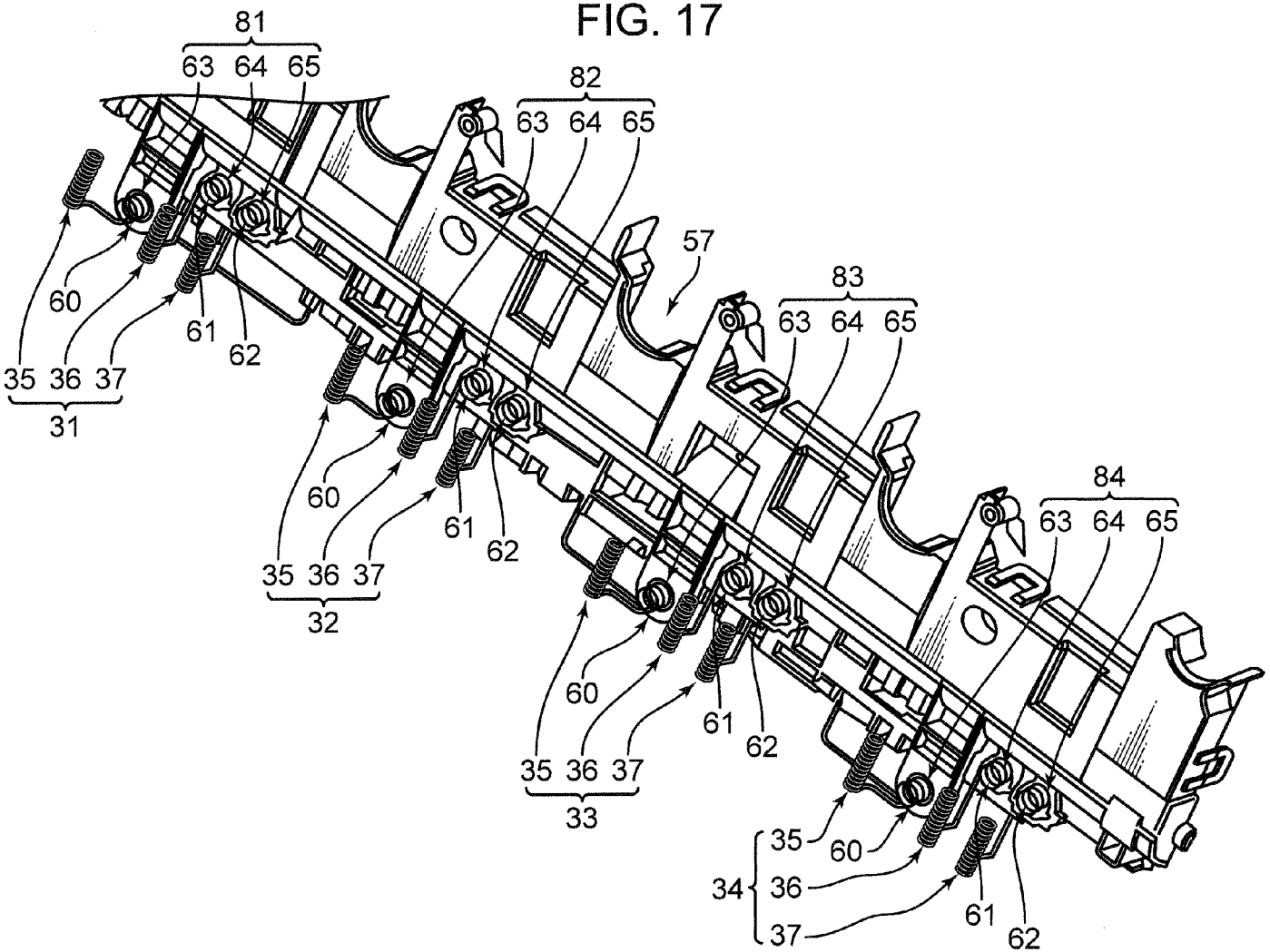
FIG. 17 is a perspective view showing a state where the first contacts of the unit-side holding member and the second contacts held by the first holding member are in contact.
Figure 18:
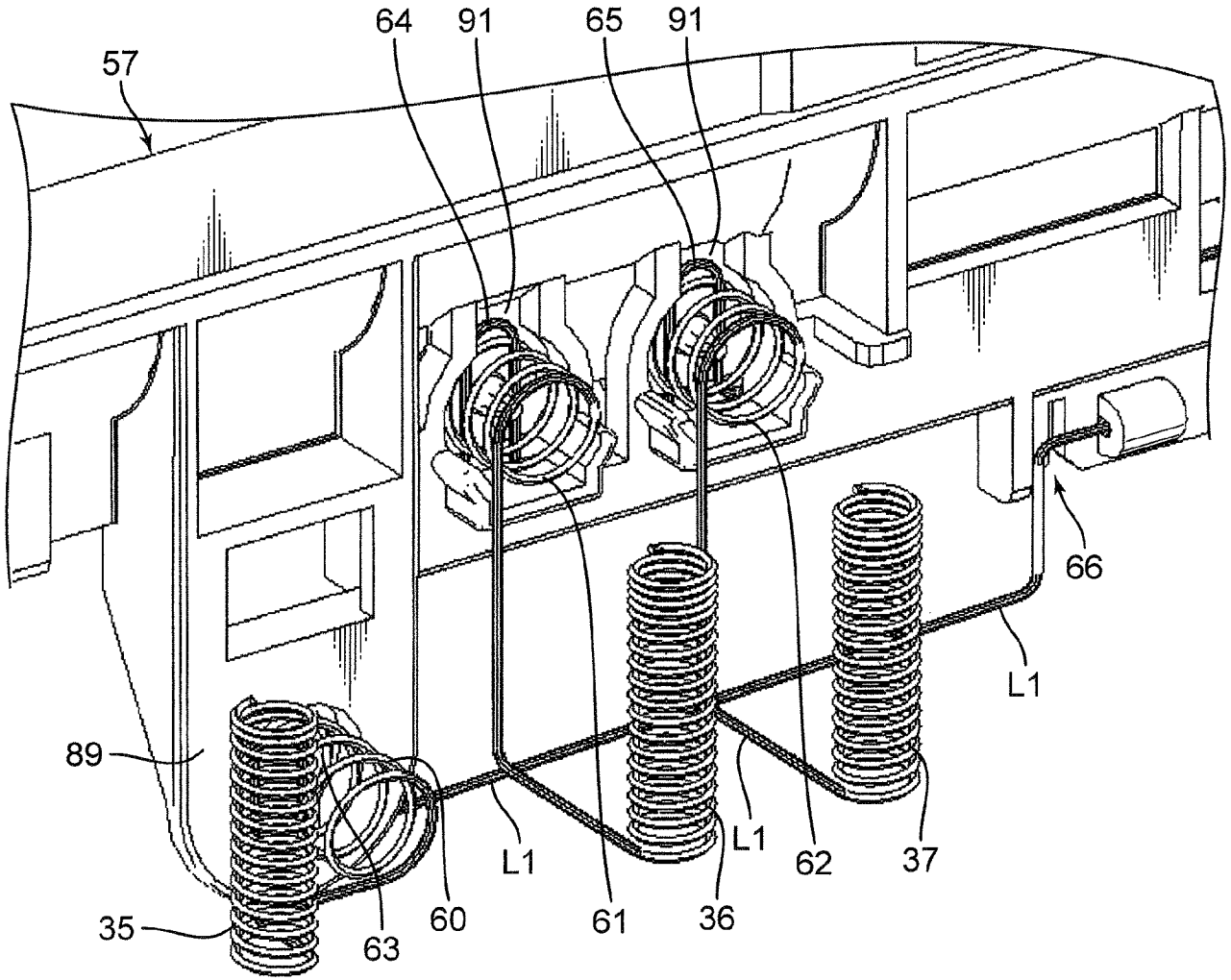
FIG. 18 is a partial enlarged view of FIG. 17.

FIGS. 17 and 18 are perspective views showing a state where the first contacts 60, 61 and 62 held by the unit-side holding member 55 and the second contacts 63, 64 and 65 held by the first holding member 57 are in contact. Note that FIGS. 17 and 18 show only the first contacts 60, 61 and 62 and the output-side contacts 35, 36 and 37 without showing the unit-side holding member 55 in order to clearly show a contact state. In a state where the unit-side holding member 55 is mounted on the inner surface of the lower frame part 21*b* (FIG. 5) and the first holding member 57 is mounted on the outer surface of the lower frame part 21*b*, the first contacts 60, 61 and 62 are in contact with the corresponding second contacts 63, 64 and 65 in the recesses 91 and are elastically deformed to be compressed in a direction to contact the second contacts 63, 64 and 65. Thus, the first contacts 60, 61 and 62 act to constantly apply biasing forces (pressing forces) to the second contacts 63, 64 and 65 in this contact state.

Figure 19:
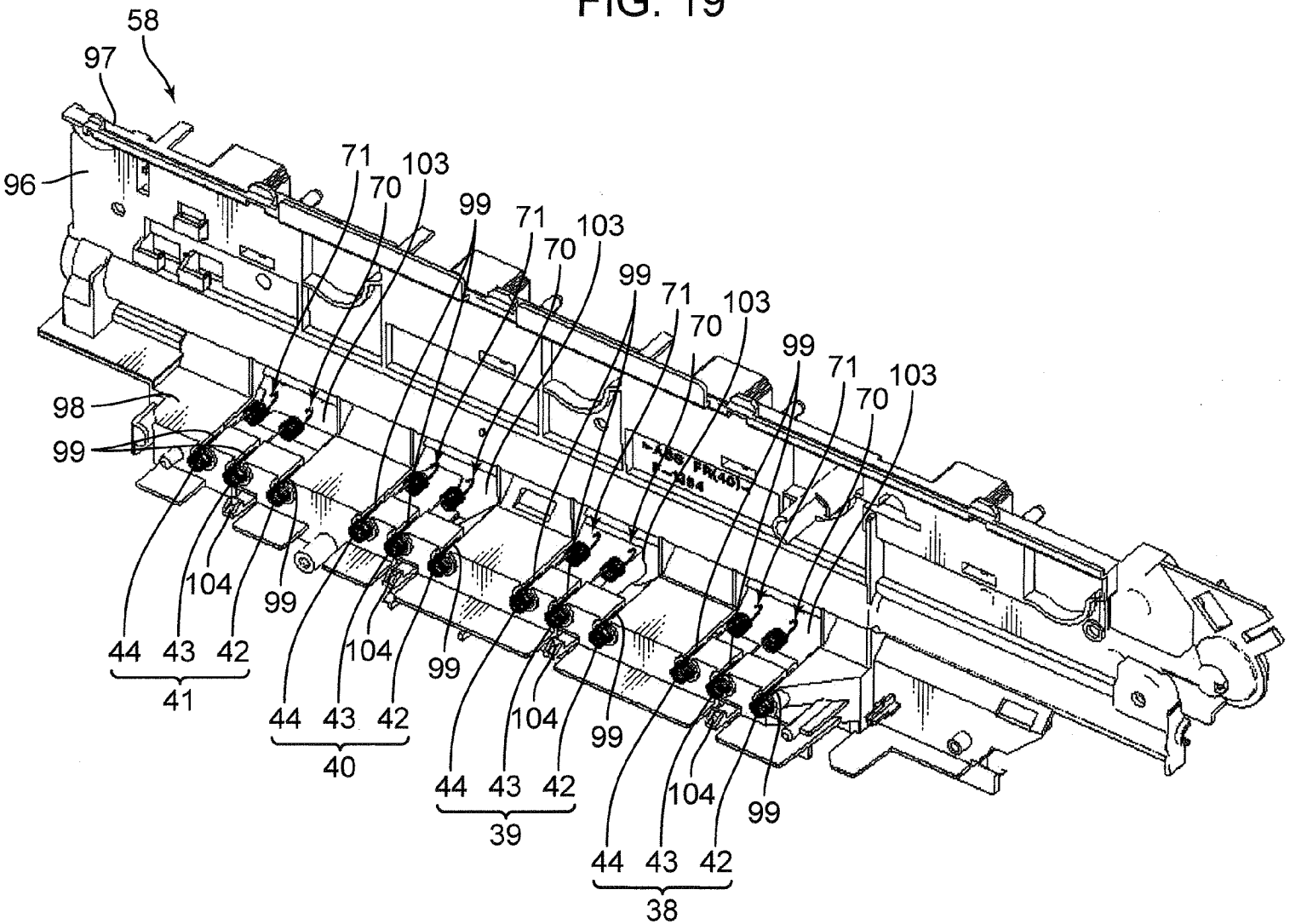
FIG. 19 is a perspective view of the second holding member when viewed from the high-voltage board.
Figure 20:
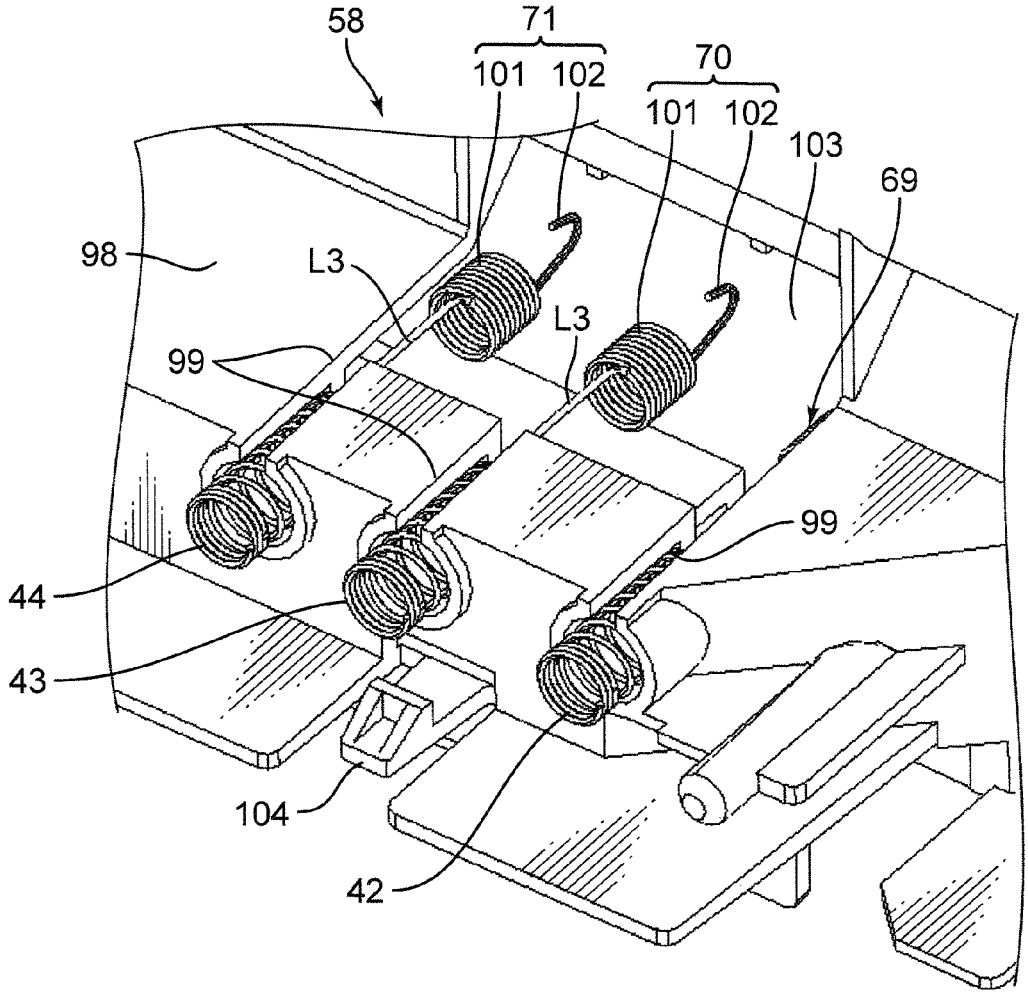
FIG. 20 is a partial enlarged view of FIG. 19.

Next, a specific structure of the second holding member 58 of the board-side holding member 56 is described with reference to FIGS. 19 and 20. FIG. 19 is a perspective view of the second holding member 58 when viewed from the high-voltage board 28, i.e. a side opposite to the first holding member 57 and FIG. 20 is a partial enlarged view of FIG. 19.

The second holding member 58 is a long and narrow plate-like member to be mounted on the second surface 80 of the first holding member 57 and has a front surface 96 facing the high-voltage board 28 and a rear surface 97 located opposite to the front surface 96 and facing the second surface 80 of the first holding member 57. The second holding member 58 holds 12 third wire members L3 as described above.

The second holding member 58 includes, on the front surface 96, a supporting plate 98 substantially horizontally extending from the lower edge portion toward the high-voltage board 28 and substantially over the entire length in the longitudinal direction. The supporting plate 98 is for holding the respective input-side contacts 42, 43 and 44 of the first to fourth input-side contact groups 38, 39, 40 and 41 and includes 12 holding grooves 99 extending from the front surface 96 toward the high-voltage board 28. The input-side contacts 42, 43 and 44 are fitted into these holding grooves 99. Leading end portions of the input-side contacts 42, 43 and 44 (seventh end portions of the third wire members L3) are exposed to the outside from the holding grooves 99.

As described above, the fourth contacts 69, 70 and 71 are formed at the other end portions (eighth end portions) of the third wire members L3. The fourth contacts 69, 70 and 70 include coiled coil portions 101 and locking portions 102 located at sides of the coil portions 101 opposite to the input-side contacts 42, 43 and 44 and integrally extending from the coil portions 101. The locking portions 102 are in the form of hooks and can lock the third contacts 66, 67 and 68. The fourth contacts 69, 70 and 71 are located on the rear surface 97 of the second holding member 58 through window portions 103 cut from the lower edge portion to the supporting plate 98. In the first to fourth input-side contact groups 38, 39, 40 and 41, the third wire members L3 formed with the input-side contacts 42, 43 and 44 and the fourth contacts 69, 70 and 71 are identically shaped.

A plurality of holding claws 104 are provided along the leading end edge of the supporting plate 98 of the second holding member 58. In FIG. 19, four holding claws 104 are provided at predetermined intervals from each other. The holding claws 104 hold the lower edge portion of the high-voltage board 28 where the board contacts 49, 50 and 51 are provided.

The fourth contacts 69, 70 and 71 of the first input-side contact group 38 correspond to the third contact group 85 (FIG. 15), those of the second input-side contact group 39 to the third contact group 86, those of the third input-side contact group 40 to the third contact group 87, and those of the fourth input-side contact group 41 to the third contact group 88. In each of the first to fourth input-side contact groups 38, 39, 40 and 41, the fourth contact 69 corresponds to the third contact 66, the fourth contact 70 to the third contact 67 and the fourth contact 71 to the third contact 68.

Figure 21:
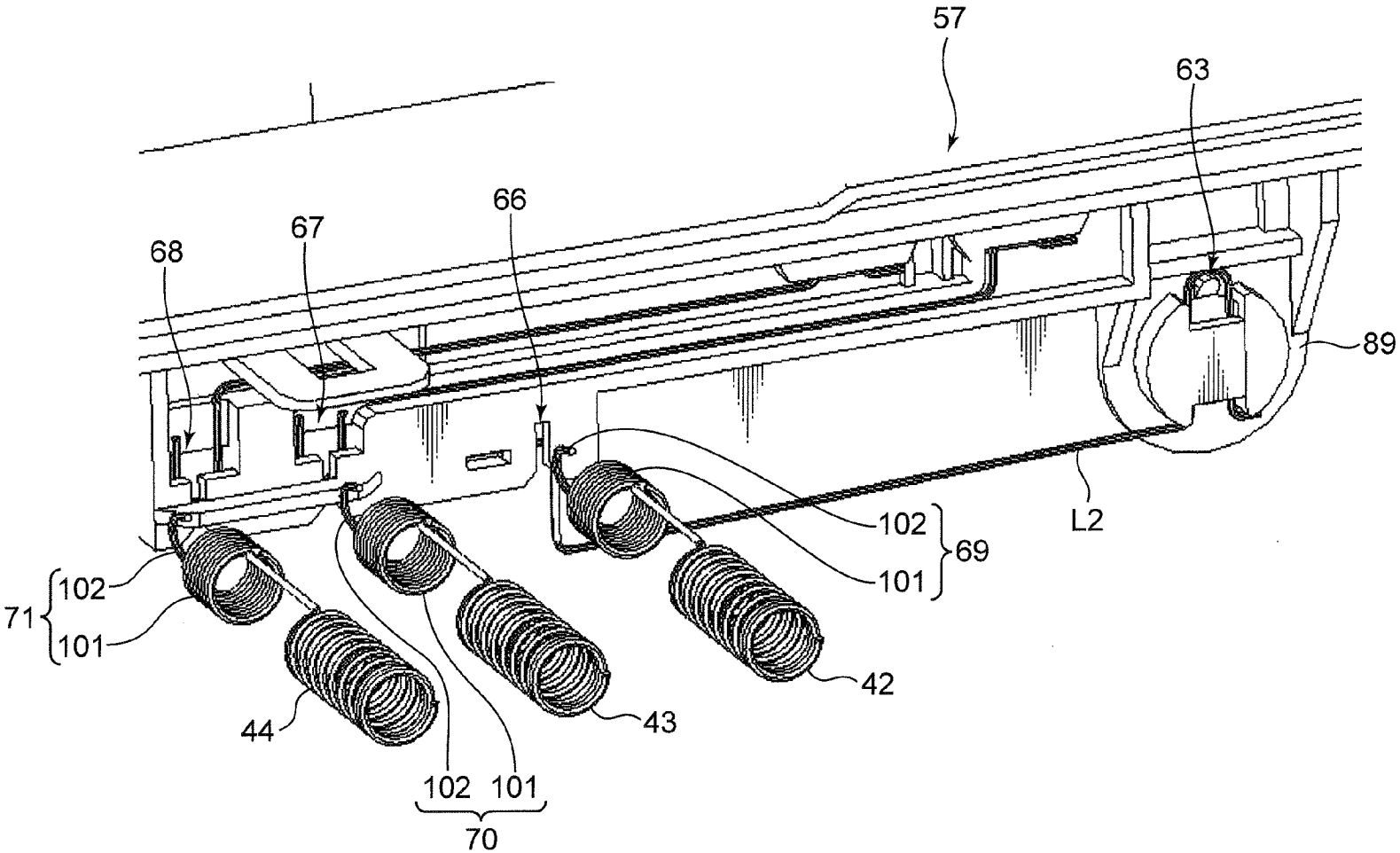
FIG. 21 is a partial enlarged perspective view showing a state before fourth contacts are locked to the third contacts.
Figure 22:
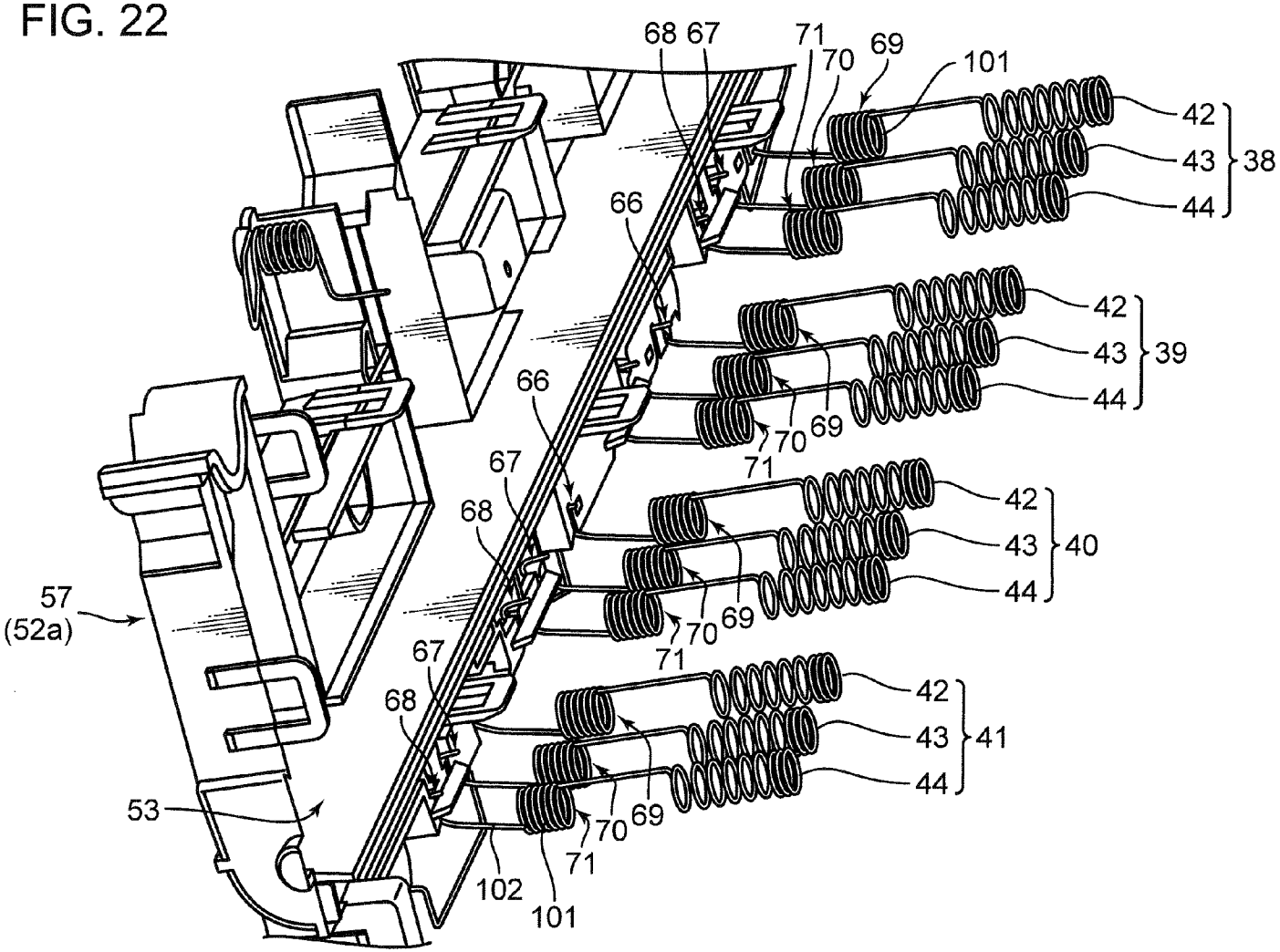
FIG. 22 is a perspective view showing a state where the fourth contacts are locked to the third contacts.

FIG. 21 is a partial enlarged perspective view showing a state before the fourth contacts 69, 70 and 71 are locked by the third contacts 66, 67 and 68. FIG. 22 is a perspective view showing a state where the fourth contacts 69, 70 and 71 are locked by the third contacts 66, 67 and 68. Note that FIGS. 21 and 22 show only the input-side contacts 42, 43 and 44 and the fourth contacts 69, 70 and 71 without showing the second holding member 58 in order to clearly show the state before locking and the locked state.

As shown in FIG. 21, when the second holding member 58 is assembled with the first holding member 57, the locking portions 102 of the fourth contacts 69, 70 and 71 are hooked to the corresponding third contacts 66, 67 and 68. As shown in FIG. 22, the coil portions 101 of the fourth contacts 69, 70 and 71 are elastically deformed to extend with the fourth contacts 69, 70 and 71 hooked to the third contacts 66, 67 and 68. Thus, the fourth contacts 69, 70 and 71 constantly apply biasing forces (forces pulling toward the input-side contacts) to the third contacts 66, 67 and 68 in the locked state.

The structure of the board-side holding member 56 (first and second holding members 57, 58) has been described above with reference to FIGS. 13 to 22. In this embodiment, the first and second holding members 57, 58 are formed utilizing the waste toner unit 52 originally provided in the image forming apparatus 10. As shown in FIG. 6, the waste toner unit 52 is a unit part extending along the step 23 (FIG. 2) on the upper edge portion of the lower frame part 21*b*.

Figure 23:
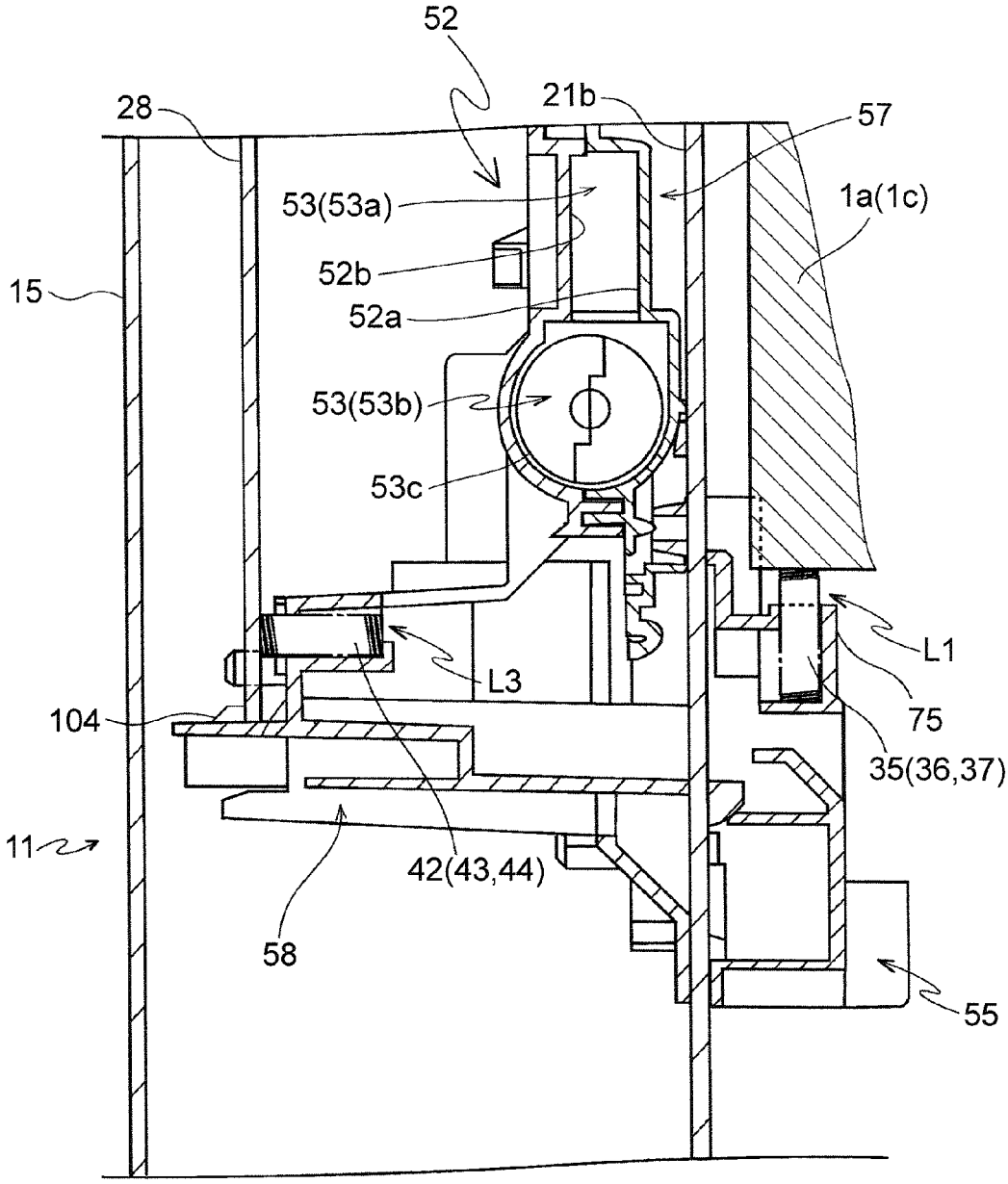
FIG. 23 is a sectional view showing an essential part of the image forming apparatus according to the embodiment of the invention when viewed from a rear side of an apparatus main body.

FIG. 23 is a sectional view showing an essential part of the image forming apparatus 10 when viewed from the rear side of the housing 11. The waste toner unit 52 internally includes a discharge part 53 (see FIGS. 9 and 22) for discharging the waste toner to the outside. The discharge path 53 is defined by a housing. The housing includes a first housing part 52*a* extending along the upper edge portion of the lower frame part 21*b* and a second housing part 52*b* defining the discharge path 53 by facing the first housing part 52*a*. The first housing part 52*a* forms the first holding member 57 at its lower end portion and the second housing part 52*b* forms the second holding member 58 at its lower end portion. In other words, the first holding member 57 for holding the second wire members L2 is a part of the first housing part 52*a* and the second holding member 58 for holding the third wire members L3 is a part of the second housing part 52*b*.

The discharge path 53 includes vertical discharge paths 53*a* provided in correspondence with one ends of the respective drum units 1*a*, having open upper ends and extending in the vertical direction and a horizontal discharge path 53*b* where the lower ends of the vertical discharge paths 53*a* join and which extends in the horizontal direction. When the respective drum units 1*a* are mounted into the accommodation space S of the housing 11, toner discharge openings of the respective drum units 1*a* face the openings of the vertical discharge paths 53*a*. The collected toners sent out from the drum units 1*a* fall down along the vertical discharge paths 53*a* by gravity and enter the horizontal discharge path 53*b*. The horizontal discharge path 53*b* has a cylindrical shape and a screw member 53*c* to be driven and rotated is provided therein. The waster toner having fallen from the vertical discharge paths 53*a* is conveyed toward one end in an axial direction by the screw member 53*c* and falls into an unillustrated collection tank to be collected.

Next, a procedure of connecting the first wire members L1 as the unit-side wire members and the second and third wire members L2, L3 as the board-side wire members is described mainly with reference to FIG. 10. First, the first and second housing parts 52*a*, 52*b* are assembled, i.e. the first holding member 57 holding the second wire members L2 and the second holding member 58 holding the third wire members L3 are assembled, to connect the second and third wire members L2, L3. The second and third wire members L2, L3 are connected by locking the locking portions 102 of the fourth contacts 69, 70 and 71 of the third wire members L3 to the third contacts 66, 67 and 68 of the corresponding second wire members L2.

Since the coil portions 101 of the fourth contacts 69, 70 and 71 are elastically deformed to extend with the fourth contacts 69, 70 and 71 locked to the third contacts 66, 67 and 68, the fourth contacts 69, 70 and 71 constantly apply biasing forces (forces pulling toward the input-side contacts 42, 43 and 44) to the third contacts 66, 67 and 68. In this way, sufficient contact pressures are obtained between the third contacts 66, 67 and 68 and the fourth contacts 69, 70 and 71 and the third wire members L3 are reliably electrically connected to the second wire members L2.

If the unit-side holding member 55 is mounted on the inner surface of the lower frame part 21*b* beforehand, the waste toner unit 52, i.e. the first holding member 57 of the board-side holding member 56 is subsequently mounted on the outer surface of the lower frame part 21*b*. At this time, the second contacts 63, 64 and 65 of the second wire members L2 held by the first holding member 57 come into contact with the corresponding first contacts 60, 61 and 62 held by the unit-side holding member 55 to press the first contacts 60, 61 and 62 in their contact direction. Then, the coiled first contacts 60, 61 and 62 are elastically deformed to be compressed. Thus, the first contacts 60, 61 and 62 can constantly apply biasing forces (pressing forces) to the second contacts 63, 64 and 65. In this way, sufficient contact pressures are obtained between the first contacts 60, 61 and 62 and the second contacts 63, 64 and 65 and the first wire members L1 and the second wire member L2 are reliably electrically connected. As a result, the first wire member L1, the second wire member L2 and the third wire member L3 become one conducting wire.

Then, the high-voltage board 28 is mounted on the upper frame part 21*a* with the lower edge portion thereof hooked to the holding claws 104 of the second holding member 58. At this time, the board contacts 49, 50 and 51 (FIG. 7) of the high-voltage board 28 come into contact with the input-side contacts 42, 43 and 44 of the corresponding third wire members L3 to press the input-side contacts 42, 43 and 44 in their contact direction. Then, the coiled input-side contacts 42, 43 and 44 are elastically deformed to be compressed. Thus, the input-side contacts 42, 43 and 44 can constantly apply biasing forces (pressing forces) to the corresponding board contacts 49, 50 and 51. In this way, sufficient contact pressures are obtained between the input-side contacts 42, 43 and 44 and the board contacts 49, 50 and 51 and the third wire members L3 and the high-voltage board 28 are reliably electrically connected.

On the other hand, when the drum units 1*a* and the developing units 1*c* are mounted into the accommodation space S, the unit contacts (not shown) of the drum units 1*a* and the developing units 1*c* come into contact with the corresponding output-side contacts 35, 36 and 37 held by the unit-side holding member 55 to press the output-side contacts 35, 36 and 37 in their contact direction. Then, the coiled output-side contacts 35, 36 and 37 are elastically deformed to be compressed. Thus, the output-side contacts 35, 36 and 37 can constantly apply biasing forces (pressing forces) to the corresponding unit contacts. In this way, sufficient contact pressures are obtained between the output-side contacts 35, 36 and 37 and the unit contacts and the first wire members L1 and the drum units 1*a* and developing units 1*c* are reliably electrically connected.

When the first, second and third wire members L1, L2 and L3 are electrically connected, the first wire members L1 are electrically connected to the drum units 1*a* and the developing units 1*c* and the third wire members L3 are electrically connected to the high-voltage board 28 as described above, the high-voltage board 28 can supply high voltages to the drum units 1*a* and the developing units 1*c*. Note that sufficient contact pressures can be obtained between the first contacts 60, 61 and 62 and the second contacts 63, 64 and 65 even if the board-side holding member 56 is first mounted on the outer surface of the lower frame part 21*b* and then the unit-side holding member 55 is mounted on the inner surface of the lower frame part 21*b*.

According to the image forming apparatus 10 of this embodiment described above, only by forming the first contacts 60, 61 and 62 as contacts with biasing shapes (coiled shapes) and the second contacts 63, 64 and 65 as contacts which can come into contact with the first contacts 60, 61 and 62, electrical connection can be reliably established between the first contacts 60, 61 and 62 and the second contacts 63, 64 and 65, thus between the processing units such as the drum units 1*a* and the developing units 1*c* and the high-voltage board 28 when the unit-side holding member 55 and the board-side holding member 56 are mounted on the lower frame part 21*b*. Therefore, the processing units and the high-voltage board 28 can be electrically connected by the simply shaped connecting members (first contacts 60, 61 and 62 and second contacts 63, 64 and 65) even if the waste toner unit 52 is a part separate from the board-side holding member 56 and the waste toner unit 52 is interposed between the processing units and the high-voltage board 28 when the board-side holding member 56 is mounted on the lower frame part 21*b*.

Further, since the unit-side holding member 55 and the board-side holding member 55 are made of resin in the image forming apparatus 10 according to this embodiment, the unit-side wire members L1 and the board-side wire members L2, L3 can be insulated from the first sheet-metal frame 21 made of a sheet-metal.

The board-side holding member 56 is a part of the housing of the waste toner unit 52 in the image forming apparatus 10 according to this embodiment. Since the board-side wire members (second wire members L2) and the unit-side wire members (first wire members L1) can be easily connected as described above, assemblability when the waste toner unit 52 is mounted on the lower frame part 21*b* is not deteriorated. Further, no independent member is necessary to hold the board-side wire members.

Further, in the image forming apparatus 10 according to this embodiment, the first holding member 57 is a part of the first housing part 52*a* of the waste toner unit 52 and the second holding member 58 is a part of the second housing part 52*b*. The second and third wire members L2, L3 can be easily electrically connected only by locking the locking portions 102 of the fourth contacts 69, 70 and 71 to the third contacts 66, 67 and 68. Thus, assemblability when the second housing part 52*b* is attached to the first housing part 52*a* to form the discharge path 53 is not deteriorated.

Note that the specific embodiment described above mainly includes inventions having the following constructions.

An image forming apparatus according to one aspect of the present invention includes a first unit for performing an image forming process on a sheet; a housing including a frame member having a first surface and a second surface opposite to the first surface, the first and second surface defining an accommodation space for accommodating the first unit; a second unit to be mounted on the second surface of the frame member to perform a predetermined operation as the image forming process is performed by the first unit; a high-voltage board to be mounted on the second surface of the frame member with the second unit located therebetween for supplying a high voltage to the first unit; and a connecting mechanism for electrically connecting the first unit and the high-voltage board to supply the high voltage to the first unit; wherein the connecting mechanism includes a unit-side wire member extending in the accommodation space and a board-side wire member connectable to the unit-side wire member and extending outside the accommodation space; the unit-side wire member includes a first end portion connectable to the first unit and a second end portion opposite to the first end portion; the board-side wire member includes a third end portion connectable to the high-voltage board and a fourth end portion opposite to the third end portion; one of the second and fourth end portions serves as a first contact with a biasing shape and the other serves as a second contact which can come into contact with the first contact; and the first contact is pressed into contact with the second contact while accumulating a biasing force when the unit-side wire member and the board-side wire member are connected.

According to this construction, since the first contact is the contact with the biasing shape and the second contact is the contact that can come into contact with the first contact, the first contact is pressed into contact with the second contact while accumulating a biasing force when the unit-side wire member and the board-side wire member are connected. Thus, a sufficient contact pressure is obtained between the first and second contacts and electrical connection is established between the unit-side wire member and the board-side wire member, thus between the first unit and the high-voltage board. Therefore, even if the second unit is interposed between the first unit and the high-voltage board, the first unit and the high-voltage board can be electrically connected by simply shaped connecting members.

In a preferred embodiment of the present invention, the frame member is made of a sheet-metal; and the connecting mechanism further includes a unit-side holding member made of resin and adapted to hold the unit-side wire member and a board-side holding member made of resin and adapted to hold the board-side wire member.

According to this construction, the unit-side wire member and the board-side wire member can be insulated from the frame member made of the sheet-metal.

In another preferred embodiment of the present invention, the second unit includes a housing; and the board-side holding member is a part of the housing.

According to this construction, assemblability when the second unit is mounted on the frame member is not deteriorated. Further, no independent member is necessary to hold the board-side wire member.

In still another preferred embodiment of the present invention, the first unit is a processing unit for performing an image forming process to form a toner image on the sheet using toner; the second unit is a waste toner unit including a discharge path for discharging waste toner, which was not used in the image forming process, the discharge path being defined by the housing.

According to this construction, the connecting mechanism can be built, utilizing the waste toner unit.

In still another preferred embodiment of the present invention, the housing includes a first housing part extending along the frame member and a second housing part defining the discharge path by facing the first housing part; the board-side wire member includes a first board-side wire member and a second board-side wire member; the first board-side wire member includes a fifth end portion formed with the first or second contact and a sixth end portion formed with the third contact; the second board-side wire member includes a seventh end portion connectable to the high-voltage board and an eighth end portion formed with a fourth contact which can be locked to the third contact; the board-side holding member includes a first holding member for holding the first board-side wire member and a second holding member for holding the second board-side wire member; the first holding member is a part of the first housing part; and the second holding member is a part of the second housing part.

According to this construction, the first and second board-side wire members can be electrically connected only by locking the third and fourth contacts to each other. Thus, assemblability when the second housing part is attached to the first housing part to form the discharge path is not deteriorated.

In still another preferred embodiment of the present invention, the frame member is made of a sheet-metal; the connecting mechanism further includes a unit-side holding member made of an electric insulator and adapted to hold the unit-side wire member and a board-side holding member made of an electric insulator and adapted to hold the board-side wire member; and the unit-side wire member and the board-side wire member are metal wires having no insulation coatings.

According to this construction, since the unit-side wire member and the board-side wire member can be insulated from the frame member made of the sheet-metal, inexpensive metal wires having no insulation coatings can be used as these wire members.

As described above, according to the image forming apparatus of the present invention, even if another unit is interposed between the processing unit used for the image forming process and the high-voltage board, the processing unit and the high-voltage board can be electrically connected by the simply shaped first and second contacts.

This application is based on Japanese Patent application No. 2010-129914 filed in Japan Patent Office on Jun. 7, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

a processing unit for performing an image forming process using a toner to form an image on a sheet;

a housing body including a frame member made of a sheet metal and having a first surface and a second surface opposite to the first surface, the first and second surface defining an accommodation space for accommodating the processing unit;

a waste toner unit to be mounted on the second surface of the frame member, the waste toner unit including a unit housing and a discharge path for discharging waste toner that was not used in the image forming process, the discharge path being defined by the unit housing;

a high-voltage board to be mounted on the second surface of the frame member with the second unit located therebetween for supplying a high voltage to the first unit; and a connecting mechanism for electrically connecting the first unit and the high-voltage board to supply the high voltage to the first unit;

wherein:

the connecting mechanism includes a unit-side wire member extending in the accommodation space, a unit-side holding member made of resin and adapted to hold the unit-side wire member, a board-side wire member connectable to the unit-side wire member and extending outside the accommodation space, and a board-side holding member made of resin and adapted to hold the board-side wire member, the board-side holding member being a part of the unit housing;

the unit-side wire member includes a first end portion connectable to the first unit and a second end portion opposite to the first end portion;

the board-side wire member includes a third end portion connectable to the high-voltage board and a fourth end portion opposite to the third end portion;

one of the second and fourth end portions serves as a first contact with a biasing shape and the other serves as a second contact which can come into contact with the first contact; and the first contact is pressed into contact with the second contact while accumulating a biasing force when the unit-side wire member and the board-side wire member are connected.

2. An image forming apparatus according to claim 1, wherein:

the unit housing includes a first housing part extending along the frame member and a second housing part defining the discharge path by facing the first housing part;

the board-side wire member includes a first board-side wire member and a second board-side wire member;

the first board-side wire member includes a fifth end portion formed with the first or second contact and a sixth end portion formed with a third contact;

the second board-side wire member includes a seventh end portion connectable to the high-voltage board and an eighth end portion formed with a fourth contact which can be locked to the third contact;

the board-side holding member includes a first holding member for holding the first board-side wire member and a second holding member for holding the second board-side wire member;

the first holding member is a part of the first housing part; and the second holding member is a part of the second housing part.

3. An image forming apparatus according to claim 1, wherein:

the unit-side holding member is made of an electric insulator and the board-side holding member is made of an electric insulator; and the unit-side wire member and the board-side wire member are metal wires having no insulation coatings.

4. An image forming apparatus, comprising:

a first unit for performing an image forming process on a sheet;

a frame member made of a sheet metal and having a first surface facing the first unit and a second surface opposite to the first surface;

a second unit to be mounted on the second surface of the frame member;

a high-voltage board to be mounted on the second surface of the frame member with the second unit located therebetween for supplying a high voltage to the first unit;

a fan arranged at the second surface of the frame member; and a connecting mechanism for electrically connecting the first unit and the high-voltage board to supply the high voltage to the first unit;

wherein:

the connecting mechanism includes a unit-side wire member extending at a side of the first surface, a unit-side holding member made of resin and adapted to hold the unit-side wire member, a board-side wire member connectable to the unit-side wire member and extending at a side of the second surface, and a board-side holding member made of resin and adapted to hold the board-side wire member;

the unit-side holding member includes a part configured to form a ventilation path with a part to receive air blown by the fan and an opening to blow the air to the first unit therethrough;

the unit-side wire member includes a first end portion connectable to the first unit and a second end portion opposite to the first end portion;

the board-side wire member includes a third end portion connectable to the high-voltage board and a fourth end portion opposite to the third end portion;

one of the second and fourth end portions serves as a first contact with a biasing shape and the other serves as a second contact which can come into contact with the first contact; and the first contact is pressed into contact with the second contact while accumulating a biasing force when the unit-side wire member and the board-side wire member are connected.

* * * * *